US010870806B2

(12) United States Patent
Brown et al.

(10) Patent No.: US 10,870,806 B2
(45) Date of Patent: Dec. 22, 2020

(54) HYDROPROCESSING OF CATALYTIC SLURRY OIL AND COKER BOTTOMS

(71) Applicant: ExxonMobil Research and Engineering Company, Annandale, NJ (US)

(72) Inventors: Stephen H. Brown, Lebanon, NJ (US); Brian A. Cunningham, Tokyo (JP); Randolph J. Smiley, Hellertown, PA (US); Samia Ilias, Bridgewater, NJ (US); Brenda A. Raich, Annandale, NJ (US); Tien V. Le, Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 264 days.

(21) Appl. No.: 15/928,436

(22) Filed: Mar. 22, 2018

(65) Prior Publication Data

US 2018/0291291 A1 Oct. 11, 2018

Related U.S. Application Data

(60) Provisional application No. 62/482,753, filed on Apr. 7, 2017.

(51) Int. Cl.

| | |
|---|---|
| ***C10G 69/04*** | (2006.01) |
| ***C10G 69/06*** | (2006.01) |
| ***C10G 45/00*** | (2006.01) |
| ***C10G 45/04*** | (2006.01) |
| ***C10G 47/02*** | (2006.01) |
| ***C10G 67/04*** | (2006.01) |
| ***C10B 49/22*** | (2006.01) |
| ***C10B 57/04*** | (2006.01) |
| ***C10G 69/14*** | (2006.01) |
| ***C10G 47/00*** | (2006.01) |

(52) U.S. Cl.

CPC ..... *C10G 69/04* (2013.01); *C10B 49/22* (2013.01); *C10B 57/045* (2013.01); *C10G 45/00* (2013.01); *C10G 45/04* (2013.01); *C10G 47/00* (2013.01); *C10G 47/02* (2013.01); *C10G 67/0454* (2013.01); *C10G 69/06* (2013.01); *C10G 69/14* (2013.01); *C10G 2300/205* (2013.01); *C10G 2300/206* (2013.01)

(58) Field of Classification Search

CPC .... C10G 67/0463; C10G 69/04; C10G 69/06; C10G 2300/202

See application file for complete search history.

(56) References Cited

U.S. PATENT DOCUMENTS

| | | | | |
|---|---|---|---|---|
| 5,871,634 | A | 2/1999 | Wiehe et al. | |
| 6,676,829 | B1 * | 1/2004 | Angevine | C10G 45/52 208/210 |
| 2013/0240407 | A1 | 9/2013 | Gillis | |
| 2017/0022433 | A1 | 1/2017 | Brown et al. | |

FOREIGN PATENT DOCUMENTS

| | | | |
|---|---|---|---|
| WO | WO-2017019263 A1 * | 2/2017 | C10G 67/049 |

OTHER PUBLICATIONS

The International Search Report and Written Opinion of PCT/US2018/023743 dated Aug. 20, 2018.

Robinson et al., "Chapter 7: Hydrotreating and Hydrocracking: Fundamentals", Practical Advances in Petroleum Processing, 2007, pp. 177-218.

* cited by examiner

*Primary Examiner* — Randy Boyer

(74) *Attorney, Agent, or Firm* — Andrew T. Ward; Priya G. Prasad; Ryan L. Lobato

(57) ABSTRACT

Systems and methods are provided for upgrading a mixture of catalytic slurry oil and coker bottoms by hydroprocessing. Optionally, the upgrading can further include deasphalting the mixture of catalytic slurry oil and coker bottoms to form a deasphalted oil and a deasphalter residue or rock fraction. The mixture of catalytic slurry oil and coker bottoms and/or the deasphalted oil can then be hydroprocessed to form an upgraded effluent that includes fuels boiling range products. Optionally, in some aspects where the feed mixture is deasphalted prior to hydroprocessing, the feed mixture can further include a portion of a (sour) vacuum resid.

10 Claims, 7 Drawing Sheets

HYDROPROCESSING OF CATALYTIC SLURRY OIL AND COKER BOTTOMS

CROSS-REFERENCE TO RELATED APPLICATIONS

This application claims the benefit of U.S. Provisional Application No. 62/482,753, filed on Apr. 7, 2017, the entire contents of which are incorporated herein by reference.

FIELD

Systems and methods are provided for deasphalting and hydroprocessing of various feeds, including main column bottoms from FCC processing and coker bottoms, to form hydroprocessed product fractions.

BACKGROUND

Fluid catalytic cracking (FCC) processes are commonly used in refineries as a method for converting feedstocks, without requiring additional hydrogen, to produce lower boiling fractions suitable for use as fuels. While FCC processes can be effective for converting a majority of a typical input feed, under conventional operating conditions at least a portion of the resulting products can correspond to a fraction that exits the process as a "bottoms" fraction, which can be referred to as main column bottoms. This bottoms fraction can typically be a high boiling range fraction, such as a ~650° F.+(~343° C.+) fraction. Because this bottoms fraction may also contain FCC catalyst fines, this fraction can sometimes be referred to as a catalytic slurry oil.

Another process for conversion of feedstocks without requiring addition hydrogen is coking. Coking can convert various types of feeds to fuel boiling range fractions. Coking typically also results in production of lower value light ends and coke products.

U.S. Patent Application Publication 2013/0240407 describes methods for integrating solvent deasphalting with resin hydroprocessing and delayed coking. The methods include performing low yield solvent deasphalting (less than 55 wt % deasphalted oil yield) to form a deasphalted oil and one or more residue products. In aspects where a portion of the residue products corresponds to a deasphalter resin, the resin is hydrotreated. The remaining portion of the deasphalter residue (pitch or rock) is used as a feed for a coker.

SUMMARY

In various aspects, a method for processing product fractions from a fluid catalytic cracking process and a coking process is provided. The method includes exposing a feed comprising at least 10 wt % catalytic slurry oil and 10-50 wt % coker bottoms to a hydroprocessing catalyst under effective fixed bed hydroprocessing conditions to form a hydroprocessed effluent. The coker bottoms can have an aromatic carbon content of 20 wt % to 50 wt % relative to a weight of the coker bottoms. In some aspects, a weight of catalytic slurry oil in the feed can be equal to or greater than a weight of coker bottoms in the feed. The amount of catalytic slurry oil in the feed can optionally be higher, such as at least 30 wt %, or at least 40 wt %, or still more. Prior to hydroprocessing, the catalytic slurry oil (or the feed containing the catalytic slurry oil) can optionally be settled. The effective hydroprocessing conditions can be effective for 55 wt % or more conversion of the feed relative to 566° C.

Optionally, solvent deasphalting can also be incorporated into the method. In various aspects, a method for processing a product fraction from a fluid catalytic cracking (FCC) process and a coking process is provided. The method includes performing solvent deasphalting on a feed comprising at least 10 wt % of a catalytic slurry oil and at least 10 wt % of a coker bottoms to form a deasphalted oil and a deasphalter residue. A yield of the deasphalted oil can be about 50 wt % or more relative to a weight of the feed. At least a portion of the deasphalted oil can then be exposed to a hydroprocessing catalyst under effective hydroprocessing conditions to form a hydroprocessed effluent. Optionally, the feed can further include about 10 wt % to about 60 wt % of a vacuum resid fraction having a T10 distillation point of at least 538° C. Optionally, the feed prior to deasphalting can include at least 25 wppm of particles. In such an optional aspect, the deasphalter residue can include at least 100 wppm of particles and/or the at least a portion of the deasphalted oil can include 1 wppm or less of particles.

In some aspects, the coker bottoms can include 4.0 wt % or more of micro carbon residue. Additionally or alternately, the hydroprocessed effluent can include 4.0 wt % or less of micro carbon residue. Additionally or alternately, the catalytic slurry oil can include 5.0 wt % or more of micro carbon residue.

In some aspects, the feed and/or the at least a portion of the deasphalted oil can include at least 1.0 wt % of organic sulfur. In such aspects, the hydroprocessed effluent can include about 0.5 wt % or less of organic sulfur, or about 1000 wppm or less.

In some aspects, a difference between $S_{BN}$ and $I_N$ for the feed can be about 60 or less and/or a difference between $S_{BN}$ and $I_N$ for the deasphalted oil can be 60 or more. Additionally or alternately, a difference between $S_{BN}$ and $I_N$ for the deasphalted oil can be at least 10 greater than a difference between $S_{BN}$ and $I_N$ for the feed.

In various aspects, a system is provided for processing a feedstock. The system can include a fluid catalytic cracker comprising a fluid catalytic cracking (FCC) inlet and an FCC outlet. The system can further include a coker comprising a coker inlet and a coker outlet. The system can further include a hydroprocessing stage comprising a hydroprocessing inlet and a hydroprocessing outlet. The hydroprocessing inlet can be in fluid communication with the coker outlet for receiving a coker bottoms fraction and/or in fluid communication with the FCC outlet for receiving a FCC bottoms fraction. The FCC inlet can optionally be in fluid communication with the hydroprocessing outlet for receiving a hydroprocessed gas oil boiling range fraction. A hydrotreating stage is an example of a hydroprocessing stage. Optionally, the system can further include a solvent deasphalting unit comprising a deasphalter inlet and a deasphalter outlet. In such an optional aspect, the deasphalter inlet can be in fluid communication with the coker outlet and/or the FCC outlet. In such an optional aspect, the hydroprocessing inlet can be in indirect fluid communication with the coker outlet and the FCC outlet via the deasphalter outlet.

BRIEF DESCRIPTION OF THE FIGURES

FIG. 6 shows results from performing solvent deasphalting on a feed comprising a catalytic slurry oil.

DETAILED DESCRIPTION

Figure 1:
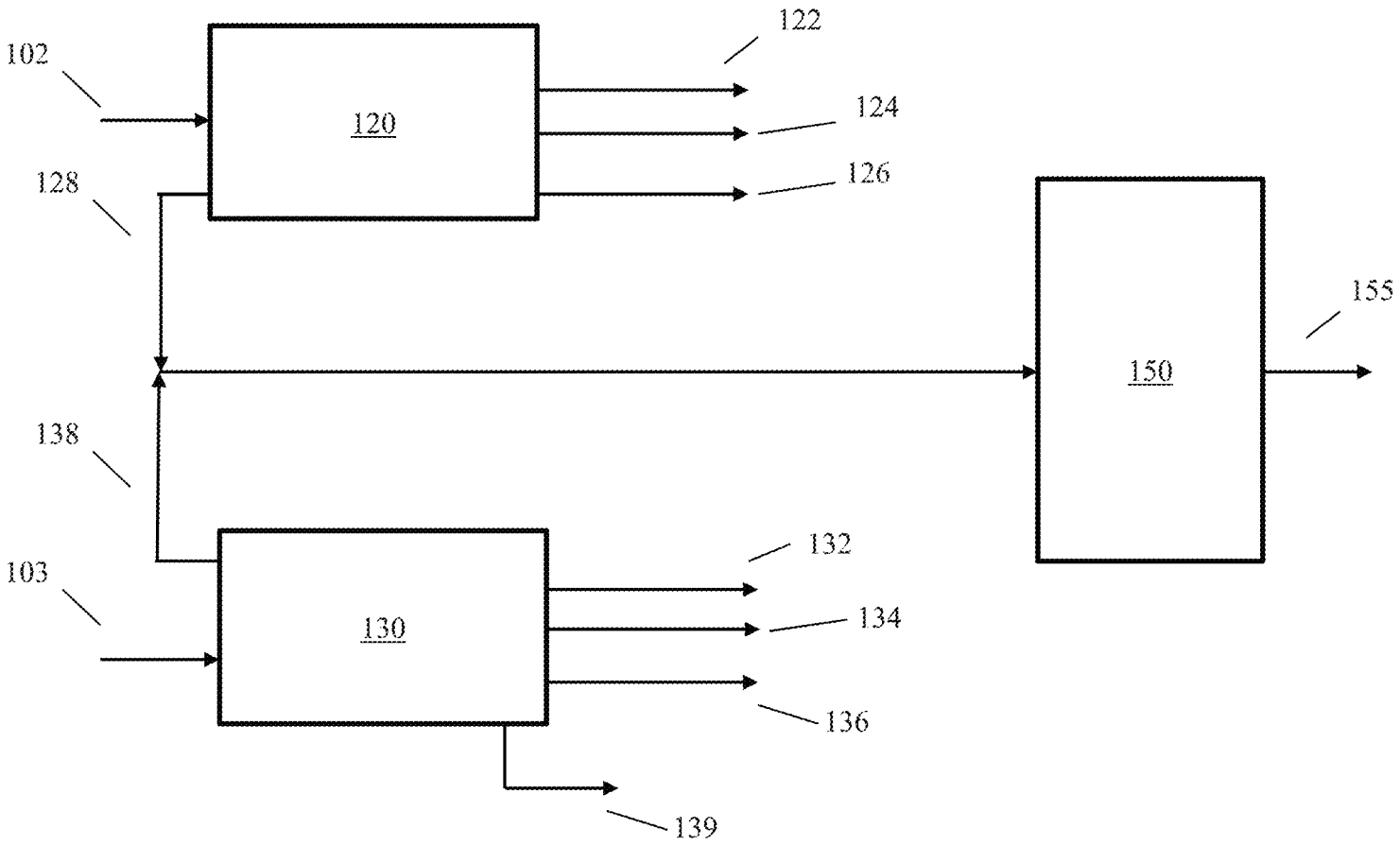
FIG. 1 shows an example of a reaction system for integrated processing of catalytic slurry oil and coker bottoms.

In various aspects, systems and methods are provided for upgrading a mixture of catalytic slurry oil and coker bottoms (e.g., a coker recycle gas oil) by hydroprocessing. Optionally, the upgrading can further include deasphalting the mixture of catalytic slurry oil and coker bottoms to form a deasphalted oil (or one or more deasphalted oils) and a deasphalter residue or rock fraction. The mixture of catalytic slurry oil and coker bottoms and/or the deasphalted oil can then be hydroprocessed to form an upgraded effluent that includes fuels boiling range products and heavier product(s) suitable for further processing. Optionally, in some aspects where the feed mixture is deasphalted prior to hydroprocessing, the feed mixture can further include a portion of a (sour) vacuum resid. The further processing can correspond to processing to form lubricant products and/or further processing in a fluid catalytic cracking unit to form fuel products. Additionally or alternately, the heavier products can be suitable for use as an (ultra) low sulfur fuel oil, such as a fuel oil having a sulfur content of ~0.5 wt % or less (or ~0.1 wt % or less).

In some aspects, the weight percent of catalytic slurry oil in the feed can be greater than or equal to the amount of coker bottoms. The amount of coker bottoms in the feed can generally be from about 5 wt % to about 50 wt %, or about 10 wt % to about 50 wt %, or about 20 wt % to about 35 wt %. The amount of catalytic slurry oil in the feed can be about 20 wt % to about 95 wt %, or about 20 wt % to about 70 wt %, or about 40 wt % to about 95 wt %, or about 50 wt % to about 95 wt %. In aspects where the feed is deasphalted prior to hydroprocessing, the feed can optionally further include 5 wt % to 40 wt % of a vacuum resid fraction. The vacuum resid fraction can have a T10 distillation point of about 510° C. or greater, or about 538° C. or greater, or about 566° C. or greater.

Coking is a thermal cracking process that is suitable for conversion of heavy feeds into fuels boiling range products. The feedstock to a coker typically also includes 5 wt % to 25 wt % recycled product from the coker, which can correspond to a bottoms portion of the liquid product generated by a coking process and can be referred to as coker bottoms. This recycle fraction allows metals, asphaltenes, micro-carbon residue, and/or other solids to be returned to the coker, as opposed to being incorporated into a coker gas oil product. This can maintain a desired product quality for the coker gas oil product, but results in a net increase in the amount of light ends and coke that are generated by a coking process. The coker bottoms can correspond to a fraction with a T10 distillation point of at least 550° F. (288° C.), or at least 300° C., or at least 316° C., and a T90 distillation point of 566° C. or less, or 550° C. or less, or 538° C. or less. The coker bottoms fraction can have an aromatic carbon content of about 20 wt % to about 50 wt %, or about 30 wt % to about 45 wt %, and a micro carbon residue content of about 4.0 wt % to about 15 wt %, or about 6.0 wt % to about 15 wt %, or about 4.0 wt % to about 10 wt %, or about 6.0 wt % to about 12 wt %. Aromatic carbon content can be determined by NMR, such as according to ASTM D5292 or a similar procedure.

Conventionally, coker bottoms are recycled to the coker to avoid difficulties associated with traditional hydroprocessing of a coker bottoms fraction. Due to the metals, asphaltenes, micro-carbon residue, and/or other solids typically present in coker bottoms, performing hydroprocessing (such as fixed bed hydroprocessing) on a coker bottoms fraction can lead to rapid catalyst deactivation and/or rapid fouling of the hydroprocessing reactor. Surprisingly, it has been discovered that the difficulties in hydroprocessing of coker bottoms can be reduced or minimized by combining the coker bottoms with a catalytic slurry oil feed prior to hydroprocessing. Without being bound by any particular theory, it is believed that the high $S_{BN}$ values of typical catalytic slurry oils can allow a catalytic slurry oil to maintain solvency of asphaltenes and/or micro-carbon residue present in a heavy coker gas oil, such as a coker bottoms fraction, during hydroprocessing.

Conventionally, a catalytic slurry oil fraction (i.e., a bottoms fraction from an FCC process) can itself be a challenging feed for hydroprocessing. A simple option would be to try to recycle the FCC bottoms to a pre-hydrotreater for the FCC process (sometimes referred to as a catalytic feed hydrotreater) and/or the FCC process itself. Unfortunately, recycle of FCC bottoms to a pre-hydrotreatment process has conventionally been ineffective, in part due to the presence of asphaltenes in the FCC bottoms. Typical FCC bottoms fractions can have a relatively high insolubility number ($I_N$) of about 70 to about 130, which corresponds to the volume percentage of toluene that would be needed to maintain solubility of a given petroleum fraction. According to conventional practices, combining a feed with an $I_N$ of greater than about 50 with a virgin crude oil fraction can lead to rapid coking under hydroprocessing conditions.

More generally, it can be conventionally understood that conversion of ~1050° F.+(~566° C.+) vacuum resid fractions by hydroprocessing and/or hydrocracking can be limited by incompatibility. Under conventional understanding, at somewhere between ~30 wt % and ~55 wt % conversion of the ~1050° F.+ (~566° C.+) portion, the reaction product during hydroprocessing can become incompatible with the feed. For example, as the ~566° C.+ feedstock converts to ~1050° F.− (~566° C.−) products, hydrogen transfer, oligomerization, and dealkylation reactions can occur which create molecules that are increasingly difficult to keep in solution. Somewhere between ~30 wt % and ~55 wt % ~566° C.+ conversion, a second liquid hydrocarbon phase separates. This new incompatible phase, under conventional understanding, can correspond to mostly polynuclear aromatics rich in N, S, and metals. The new incompatible phase can potentially be high in micro carbon residue (MCR). The new incompatible phase can stick to surfaces in the unit where it cokes and then can foul the equipment. Based on this conventional understanding, catalytic slurry oil can conventionally be expected to exhibit properties similar to a vacuum resid fraction during hydroprocessing. A catalytic slurry oil can have an $I_N$ of about 70 to about 130, ~1-6 wt % n-heptane insolubles and a boiling range profile that includes about 3 wt % to about 12 wt % or less of ~566° C.+ material. Based on the above conventional understanding, it can be expected that hydroprocessing of a catalytic slurry oil would cause incompatibility as the asphaltenes and/or ~566° C.+ material converts.

In contrast to conventional understanding, it has been discovered that hydroprocessing can be performed while reducing or minimizing the above difficulties by using a feed composed of a substantial portion of a catalytic slurry oil, with a minor amount (or less) of a conventional vacuum resid feed. A catalytic slurry oil can be processed as part of a feed where the catalytic slurry oil corresponds to at least about 25 wt % of the feed to a process for forming fuels, such as at least about 50 wt %, at least about 75 wt %, at least about 90 wt %, or at least about 95 wt %. Optionally, the feed can correspond to at least about 99 wt % of a catalytic slurry oil, therefore corresponding to a feed that consists essentially of catalytic slurry oil. In particular, a feed can comprise about 25 wt % to about 100 wt % catalytic slurry oil, or about 25 wt % to about 99 wt %, or about 50 wt % to about 90 wt %. In contrast to many types of potential feeds for production of fuels, the asphaltenes in a catalytic slurry oil can apparently be converted on a time scale comparable to the time scale for conversion of other aromatic compounds in the catalytic slurry oil. In other words, without being bound by any particular theory, the asphaltene-type compounds in a catalytic slurry oil that are susceptible to precipitation/insolubility can be converted at a proportional rate to the conversion of compounds that help to maintain solubility of asphaltene-type compounds. This can have the effect that during hydroprocessing, the rate of decrease of the $S_{BN}$ for the catalytic slurry oil can be similar to the rate of decrease of $I_N$, so that precipitation of asphaltenes during processing can be reduced, minimized, or eliminated. As a result, it has been unexpectedly discovered that catalytic slurry oil can be processed at effective hydroprocessing conditions for substantial conversion of the feed without causing excessive coking of the catalyst. This can allow hydroprocessing to be used to at least partially break down the ring structures of the aromatic cores in the catalytic slurry oil. In a sense, hydroprocessing of a catalytic slurry oil as described herein can serve as a type of "hydrodeasphalting", where the asphaltene type compounds are removed by hydroprocessing rather than by solvent extraction. In various aspects, the 566° C.+ conversion during hydroprocessing for a feed including catalytic slurry oil can be at least 55 wt %, or at least 65 wt %, or at least 75 wt %, such as up to about 95 wt % or still higher.

While conventional vacuum resids have limited compatibility for co-processing with a catalytic slurry oil, it has been further discovered that certain other challenged feeds or fractions can benefit from co-processing with a catalytic slurry oil. For example, a combined feed including a catalytic slurry oil fraction and a coker bottoms fraction can be hydroprocessed, such as under fixed bed conditions, with reduced or minimized difficulties related to catalyst deactivation and/or reactor fouling.

In some aspects, still further benefits can be achieved by deasphalting a combined feed that includes coker bottoms and catalytic slurry oil prior to hydroprocessing. Deasphalting can further increase the difference between the $S_{BN}$ and the $I_N$ for a deasphalted oil relative to the initial catalytic slurry oil. Deasphalting can potentially provide a similar benefit for the coker bottoms. Optionally, a vacuum resid fraction can be combined with the coker bottoms and catalytic slurry oil prior to deasphalting. Some potential benefits of performing solvent deasphalting on a catalytic slurry oil can be related to the resulting solubility characteristics of the deasphalted oil. The bottoms fraction from an FCC process can typically correspond to a fraction with both a high solubility number ($S_{BN}$) and a high insolubility number ($I_N$). For example, a typical catalytic slurry oil can have an $S_{BN}$ of about 100 to about 250 (or greater) and an $I_N$ of about 70 to about 130. One of skill in the art would expect that co-processing 10+ wt % of catalytic slurry oil with a vacuum gas oil feed under fixed bed conditions would result in substantial precipitation of asphaltenes and/or other types of reactor fouling and plugging. By contrast, a deasphalted oil formed from a catalytic slurry oil can be a beneficial component for co-processing with a vacuum gas oil. During solvent deasphalting with a $C_{5+}$ solvent, such as n-pentane, isopentane, or a mixture of $C_{5+}$ alkanes, a portion of the compounds contributing to the high $I_N$ value of the catalytic slurry oil can be separated into the rock fraction due to insolubility with the alkane solvent. This can result in a deasphalted oil that has an increased difference between $S_{BN}$ and $I_N$ relative to the corresponding difference for the catalytic slurry oil. For example, the difference between $S_{BN}$ and $I_N$ for the feed containing the catalytic slurry oil can be 60 or less, or 50 or less, or 40 or less, while the difference between $S_{BN}$ and $I_N$ for the corresponding deasphalted oil can be at least 60, or at least 70, or at least 80. As another example, when a deasphalted oil based on a catalytic slurry oil is used as a co-feed, the difference between $S_{BN}$ and $I_N$ for the deasphalted oil can be at least 10 greater, or at least 20 greater, or at least 30 greater than the difference between $S_{BN}$ and $I_N$ for the co-feed. This additional difference between the $S_{BN}$ and $I_N$ can reduce or minimize difficulties associated with co-processing of other heavy oil fractions with a catalytic slurry oil. Additionally, the high $S_{BN}$ values of the deasphalted oil can be beneficial for providing improved solubility properties when blending the deasphalted oil with other fractions. This can include providing improved solubility properties, for example, for a deasphalted oil formed by deasphalting a feed that includes both catalytic slurry oil and one or more other types of fractions (such as a vacuum resid fraction).

Other benefits of performing solvent deasphalting on a catalytic slurry oil can be related to the ability to remove catalyst fines. Catalytic slurry oils can typically contain catalyst fines from the prior FCC process. During solvent deasphalting, catalyst fines within a catalytic slurry oil can be concentrated in the residual or deasphalter rock fraction produced from the deasphalting process. The deasphalted oil can be substantially free of catalyst fines, even at deasphalter lifts of greater than 90 wt % (i.e., yields of deasphalted oil of greater than 90 wt %). Due to the nature of solvent deasphalting, the presence of catalyst fines in the feed to the solvent deasphalter and/or in the deasphalter rock formed during deasphalting can have a reduced or minimal impact on the deasphalting process. As a result, solvent deasphalting can allow for production of a deasphalted oil at high yield while minimizing the remaining content of catalyst fines in the deasphalted oil.

In various aspects, the deasphalting process can be performed on a feed that includes a catalytic slurry oil as well as one or more other types of crude oil fractions and/or refinery fractions. For example, a catalytic slurry oil can be processed (including deasphalting) as part of a feed where the catalytic slurry oil corresponds to at least about 5 wt % of the feed, or at least about 25 wt % of the feed, or at least about 50 wt %, or at least about 75 wt %, or at least about 90 wt %, or at least about 95 wt %. Optionally, the feed can correspond to at least about 99 wt % of a catalytic slurry oil, therefore corresponding to a feed that consists essentially of catalytic slurry oil. In particular, a feed can comprise about 5 wt % to about 100 wt % catalytic slurry oil, or about 5 wt % to about 99 wt %, or about 25 wt % to about 99 wt %, or about 50 wt % to about 90 wt %. The other portions of the feed can correspond to, for example, vacuum resid boiling range fractions (such as a vacuum resid fraction formed from a vacuum distillation column), coker bottoms fractions, and/or other fractions having a T5 distillation point of at least about 454° C., or at least about 482° C., or at least about 510° C.

An additional favorable feature of hydroprocessing a catalytic slurry oil can be the increase in product volume that can be achieved. Due to the high percentage of aromatic cores in a catalytic slurry oil, hydroprocessing of catalytic slurry oil can result in substantial consumption of hydrogen. The additional hydrogen added to a catalytic slurry oil can result in an increase in volume for the hydroprocessed catalytic slurry oil or volume swell. For example, the amount of $C_3$+ liquid products generated from hydrotreatment and FCC processing of catalytic slurry oil can be greater than ~100% of the volume of the initial catalytic slurry oil. (A similar proportional increase in volume can be achieved for feeds that include only a portion of deasphalted catalytic slurry oil.) Hydroprocessing within the normal range of commercial hydrotreater operations can enable ~2000-4000 SCF/bbl (~340 $Nm^3/m^3$ to ~680 $m^3/m^3$) of hydrogen to be added to a feed corresponding to a deasphalted catalytic slurry oil. This can result in substantial conversion of a deasphalted catalytic slurry oil feed to ~700° F.− (~371° C.−) products, such as at least about 40 wt % conversion to ~371° C.− products, or at least about 50 wt %, or at least about 60 wt %, and up to about 90 wt % or more. In some aspects, the ~371° C.− product can meet the requirements for a low sulfur diesel fuel blendstock in the U.S. Additionally or alternately, the ~371° C.− product(s) can be upgraded by further hydroprocessing to a low sulfur diesel fuel or blendstock. The remaining ~700° F.+ (~371° C.+) product can meet the normal specifications for a <~0.5 wt % S bunker fuel or a <~0.1 wt % S bunker fuel, and/or may be blended with a distillate range blendstock to produce a finished blend that can meet the specifications for a <~0.1 wt % S bunker fuel. Additionally or alternately, a ~343° C.+ product can be formed that can be suitable for use as a <~0.1 wt % S bunker fuel without additional blending. The additional hydrogen for the hydrotreatment of the catalytic slurry oil can be provided from any convenient source.

Additionally or alternately, the remaining ~371° C.+ product (and/or portions of the ~371° C.+ product) can be used as feedstock to an FCC unit and cracked to generate additional LPG, gasoline, and diesel fuel, so that the yield of ~371° C.− products relative to the total liquid product yield can be at least about 60 wt %, or at least about 70 wt %, or at least about 80 wt %. Relative to the feed, the yield of $C_3$+ liquid products can be at least about 100 vol %, such as at least about 105 vol %, at least about 110 vol %, at least about 115 vol %, or at least about 120 vol %. In particular, the yield of $C_3$+ liquid products can be about 100 vol % to about 150 vol %, or about 110 vol % to about 150 vol %, or about 120 vol % to about 150 vol %.

As defined herein, the term "hydrocarbonaceous" includes compositions or fractions that contain hydrocarbons and hydrocarbon-like compounds that may contain heteroatoms typically found in petroleum or renewable oil fraction and/or that may be typically introduced during conventional processing of a petroleum fraction. Heteroatoms typically found in petroleum or renewable oil fractions include, but are not limited to, sulfur, nitrogen, phosphorous, and oxygen. Other types of atoms different from carbon and hydrogen that may be present in a hydrocarbonaceous fraction or composition can include alkali metals as well as trace transition metals (such as Ni, V, or Fe).

In some aspects, reference may be made to conversion of a feedstock relative to a conversion temperature. Conversion relative to a temperature can be defined based on the portion of the feedstock that boils at greater than the conversion temperature. The amount of conversion during a process (or optionally across multiple processes) can correspond to the weight percentage of the feedstock converted from boiling above the conversion temperature to boiling below the conversion temperature. As an illustrative hypothetical example, consider a feedstock that includes 40 wt % of components that boil at 700° F. (~371° C.) or greater. By definition, the remaining 60 wt % of the feedstock boils at less than 700° F. (~371° C.). For such a feedstock, the amount of conversion relative to a conversion temperature of ~371° C. would be based only on the 40 wt % that initially boils at ~371° C. or greater. If such a feedstock could be exposed to a process with 30% conversion relative to a ~371° C. conversion temperature, the resulting product would include 72 wt % of ~371° C.− components and 28 wt % of ~371° C.+ components.

In various aspects, reference may be made to one or more types of fractions generated during distillation of a feedstock or effluent. Such fractions may include naphtha fractions, kerosene fractions, diesel fractions, and other heavier (gas oil) fractions. Each of these types of fractions can be defined based on a boiling range, such as a boiling range that includes at least ~90 wt % of the fraction, or at least ~95 wt % of the fraction. For example, for many types of naphtha fractions, at least ~90 wt % of the fraction, or at least ~95 wt %, can have a boiling point in the range of ~85° F. (~29° C.) to ~350° F. (~177° C.). For some heavier naphtha fractions, at least ~90 wt % of the fraction, and preferably at least ~95 wt %, can have a boiling point in the range of ~85° F. (~29° C.) to ~400° F. (~204° C.). For a kerosene fraction, at least ~90 wt % of the fraction, or at least ~95 wt %, can have a boiling point in the range of ~300° F. (~149° C.) to ~600° F. (~288° C.). For a kerosene fraction targeted for some uses, such as jet fuel production, at least ~90 wt % of the fraction, or at least ~95 wt %, can have a boiling point in the range of ~300° F. (~149° C.) to ~550° F. (~288° C.). For a diesel fraction, at least ~90 wt % of the fraction, and preferably at least ~95 wt %, can have a boiling point in the range of ~350° F. (~177° C.) to ~700° F. (~371° C.). For a (vacuum) gas oil fraction, at least ~90 wt % of the fraction, and preferably at least ~95 wt %, can have a boiling point in the range of ~650° F. (~343° C.) to ~1100° F. (~593° C.). Optionally, for some gas oil fractions, a narrower boiling range may be desirable. For such gas oil fractions, at least ~90 wt % of the fraction, or at least ~95 wt %, can have a boiling point in the range of ~650° F. (~343° C.) to 1000° F. (~538° C.), or ~650° F. (~343° C.) to ~900° F. (~482° C.). A residual fuel product can have a boiling range that may vary and/or overlap with one or more of the above boiling ranges. A residual marine fuel product can satisfy the requirements specified in ISO 8217, Table 2. The calculated carbon aromaticity index (CCAI) can be determined according to ISO 8217. BMCI can refer to the Bureau of Mines Correlation Index, as commonly used by those of skill in the art.

In this discussion, the effluent from a processing stage may be characterized in part by characterizing a fraction of the products. For example, the effluent from a processing stage may be characterized in part based on a portion of the effluent that can be converted into a liquid product. This can correspond to a $C_3$+ portion of an effluent, and may also be referred to as a total liquid product. As another example, the effluent from a processing stage may be characterized in part based on another portion of the effluent, such as a $C_5$+ portion or a $C_6$+ portion. In this discussion, a portion corresponding to a "$C_x$+" portion can be, as understood by those of skill in the art, a portion with an initial boiling point that roughly corresponds to the boiling point for an aliphatic hydrocarbon containing "x" carbons.

In this discussion, a low sulfur fuel oil can correspond to a fuel oil containing about 0.5 wt % or less of sulfur. An ultra low sulfur fuel oil, which can also be referred to as an Emission Control Area fuel, can correspond to a fuel oil containing about 0.1 wt % or less of sulfur. A low sulfur diesel can correspond to a diesel fuel containing about 500 wppm or less of sulfur. An ultra low sulfur diesel can correspond to a diesel fuel containing about 15 wppm or less of sulfur, or about 10 wppm or less.

In this discussion, reference may be made to catalytic slurry oil, FCC bottoms, and main column bottoms. These terms can be used interchangeably herein. It is noted that when initially formed, a catalytic slurry oil can include several weight percent of catalyst fines. Any such catalyst fines can be removed prior to incorporating a fraction derived from a catalytic slurry oil into a product pool, such as a naphtha fuel pool or a diesel fuel pool. In this discussion, unless otherwise explicitly noted, references to a catalytic slurry oil are defined to include catalytic slurry oil either prior to or after such a process for reducing the content of catalyst fines within the catalytic slurry oil.

Solubility Number and Insolubility Number

A method of characterizing the solubility properties of a petroleum fraction can correspond to the toluene equivalence (TE) of a fraction, based on the toluene equivalence test as described for example in U.S. Pat. No. 5,871,634 (incorporated herein by reference with regard to the definition for toluene equivalence, solubility number ($S_{BN}$), and insolubility number ($I_N$)). Briefly, the determination of the insolubility Number ($I_N$) and the Solubility Blending Number ($S_{BN}$) for a petroleum oil containing asphaltenes requires testing the solubility of the oil in test liquid mixtures at the minimum of two volume ratios of oil to test liquid mixture. The test liquid mixtures are prepared by mixing two liquids in various proportions. One liquid is nonpolar and a solvent for the asphaltenes in the oil while the other liquid is nonpolar and a nonsolvent for the asphaltenes in the oil. Since asphaltenes are defined as being insoluble in n-heptane and soluble in toluene, it is most convenient to select the same n-heptane as the nonsolvent for the test liquid and toluene as the solvent for the test liquid. Although the selection of many other test nonsolvents and test solvents can be made, their use provides not better definition of the preferred oil blending process than the use of n-heptane and toluene described here.

A convenient volume ratio of oil to test liquid mixture is selected for the first test, for instance, 1 ml. of oil to 5 ml. of test liquid mixture. Then various mixtures of the test liquid mixture are prepared by blending n-heptane and toluene in various known proportions. Each of these is mixed with the oil at the selected volume ratio of oil to test liquid mixture. Then it is determined for each of these if the asphaltenes are soluble or insoluble. Any convenient method might be used. One possibility is to observe a drop of the blend of test liquid mixture and oil between a glass slide and a glass cover slip using transmitted light with an optical microscope at a magnification of from 50 to 600×. If the asphaltenes are in solution, few, if any, dark particles will be observed. If the asphaltenes are insoluble, many dark, usually brownish, particles, usually 0.5 to 10 microns in size, will be observed. Another possible method is to put a drop of the blend of test liquid mixture and oil on a piece of filter paper and let dry. If the asphaltenes are insoluble, a dark ring or circle will be seen about the center of the yellow-brown spot made by the oil. If the asphaltenes are soluble, the color of the spot made by the oil will be relatively uniform in color. The results of blending oil with all of the test liquid mixtures are ordered according to increasing percent toluene in the test liquid mixture. The desired value will be between the minimum percent toluene that dissolves asphaltenes and the maximum percent toluene that precipitates asphaltenes. More test liquid mixtures are prepared with percent toluene in between these limits, blended with oil at the selected oil to test liquid mixture volume ratio, and determined if the asphaltenes are soluble or insoluble. The desired value will be between the minimum percent toluene that dissolves asphaltenes and the maximum percent toluene that precipitates asphaltenes. This process is continued until the desired value is determined within the desired accuracy. Finally, the desired value is taken to be the mean of the minimum percent toluene that dissolves asphaltenes and the maximum percent toluene that precipitates asphaltenes. This is the first datum point, at the selected oil to test liquid mixture volume ratio, $R_1$. This test is called the toluene equivalence test.

The second datum point can be determined by the same process as the first datum point, only by selecting a different oil to test liquid mixture volume ratio. Alternatively, a percent toluene below that determined for the first datum point can be selected and that test liquid mixture can be added to a known volume of oil until asphaltenes just begin to precipitate. At that point the volume ratio of oil to test liquid mixture, $R_2$, at the selected percent toluene in the test liquid mixture, $T_2$, becomes the second datum point. Since the accuracy of the final numbers increase as the further apart the second datum point is from the first datum point, the preferred test liquid mixture for determining the second datum point is 0% toluene or 100% n-heptane. This test is called the heptane dilution test.

The Insolubility Number, $I_N$, is given by:

$$I_N = T_2 - \left[\frac{T_2 - T_1}{R_2 - R_1}\right] R_2 \tag{1}$$

and the Solubility Blending Number, $S_{BN}$, is given by:

$$S_{BN} = I_N\left[1 + \frac{1}{R_2}\right] - \frac{T_2}{R_2} \tag{2}$$

It is noted that additional procedures are available, such as those specified in U.S. Pat. No. 5,871,634, for determination of $S_{BN}$ for oil samples that do not contain asphaltenes.

Delayed Coking and Fluidized Coking

Typical configurations for coking can include fluidized coking and delayed coking. Either fluidized coking or delayed coking can be modified to operate in a single-pass mode. In a single-pass mode, the portion of the coking effluent that would be recycled (i.e., the coker bottoms) can instead be combined with catalytic slurry oil for further processing. The further processing can include optional deasphalting followed by hydrotreatment. Optionally, the coker bottoms and catalytic slurry oil can be further combined with a vacuum resid fraction prior to deasphalting and hydrotreatment.

Fluidized coking is a refinery process in which a heavy petroleum feedstock, typically a non-distillable residue (resid) from atmospheric and/or vacuum fractionation, is converted to lighter, more valuable materials by thermal decomposition (coking) at temperatures from about 900° F. (482° C.) to about 1100° F. (593° C.). Conventional fluid coking is performed in a process unit comprised of a coking reactor and a heater or burner. A petroleum feedstock is injected into the reactor in a coking zone comprised of a fluidized bed of hot, fine, coke particles and is distributed relatively uniformly over the surfaces of the coke particles where it is cracked to vapors and coke. The vapors pass through a gas/solids separation apparatus, such as a cyclone, which removes most of the entrained coke particles. The vapor is then discharged into a scrubbing zone where the remaining coke particles are removed and the products cooled to condense the heavy liquids. The balance of the vapors go to a fractionator for separation of the gases and the liquids into different boiling fractions.

During conventional operation, the resulting slurry (which usually contains from about 1 to about 3 wt. % coke particles) is recycled to extinction to the coking zone. Instead of recycling the heavy liquids in this slurry, at least a portion of the heavy liquids (i.e., coker bottoms) can instead be combined with a catalytic slurry oil and/or a vacuum resid fraction for use as a feed to a hydrotreater (or another hydroprocessing unit). Optionally but preferably, the combined feed can be deasphalted prior to hydrotreatment.

Some of the coke particles in the coking zone flow downwardly to a stripping zone at the base of the reactor vessel where steam removes interstitial product vapors from, or between, the coke particles, and some adsorbed liquids from the coke particles. The coke particles then flow down a stand-pipe and into a riser that moves them to a burning, or heating zone, where sufficient air is injected to burn at least a portion of the coke and heating the remainder sufficiently to satisfy the heat requirements of the coking zone where the unburned hot coke is recycled. Net coke, above that consumed in the burner, is withdrawn as product coke.

Another type of fluid coking employs three vessels: a coking reactor, a heater, and a gasifier. Coke particles having carbonaceous material deposited thereon in the coking zone are passed to the heater where a portion of the volatile matter is removed. The coke is then passed to the gasifier where it reacts, at elevated temperatures, with air and steam to form a mixture of carbon monoxide, carbon dioxide, methane, hydrogen, nitrogen, water vapor, and hydrogen sulfide. The gas produced in the gasifier is passed to the heater to provide part of the reactor heat requirement. The remainder of the heat is supplied by circulating coke between the gasifier and the heater. Coke is also recycled from the heater to the coking reactor to supply the heat requirements of the reactor.

The rate of introduction of resid feedstock to a fluid coker is limited by the rate at which it can be converted to coke. The major reactions that produce coke involve cracking of aliphatic side chains from aromatic cores, demethylation of aromatic cores and aromatization. The rate of cracking of aliphatic side chains is relatively fast and results in the buildup of a sticky layer of methylated aromatic cores. This layer is relatively sticky at reaction temperature. The rate of de-methylation of the aromatic cores is relatively slow and limits the operation of the fluid coker. At the point of fluid bed bogging (defluidizing), the rate of sticky layer going to coke equals the rate of introduction of coke precursors from the resid feed. An acceleration of the reactions involved in converting the sticky material to dry coke would allow increased reactor throughput at a given temperature or coking at a lower temperature at constant throughput. Less gas and higher quality liquids are produced at lower coking temperatures. Sticky coke particles can agglomerate (become larger) and be carried under into the stripper section and cause fouling. When carried under, much of the sticky coke is sent to the burner, where this incompletely demethylated coke evolves methylated and unsubstituted aromatics via thermal cracking reactions that ultimately cause fouling and/or foaming problems in the acid gas clean-up units.

Figure 7:
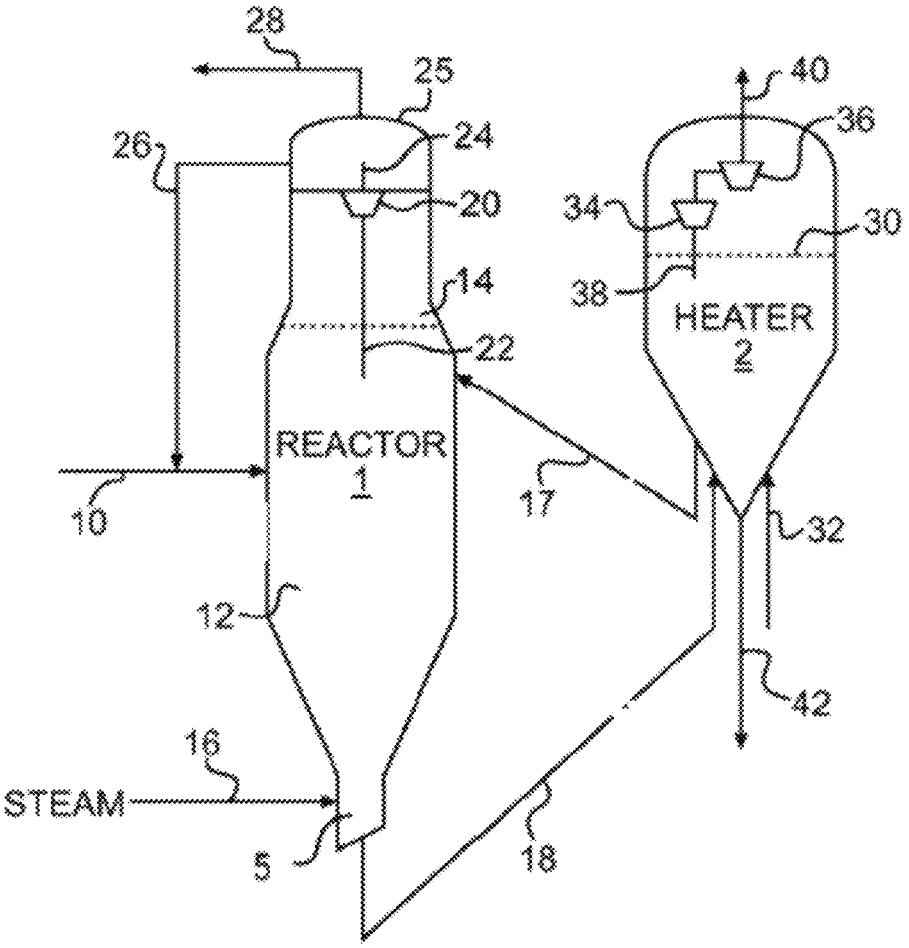
FIG. 7 schematically shows an example of a coker.

Reference is now made to FIG. 7 hereof which shows a simplified flow diagram of a typical fluidized coking process unit comprised of a coking reactor and a heater. A heavy hydrocarbonaceous chargestock is conducted via line 10 into coking zone 12 that contains a fluidized bed of solids having an upper level indicated at 14. Although it is preferred that the solids, or seed material, be coke particles, they may also be any other refractory materials such as those selected from the group consisting of silica, alumina, zirconia, magnesia, alundum or mullite, synthetically prepared or naturally occurring material such as pumice, clay, kieselguhr, diatomaceous earth, bauxite, and the like. The solids will have an average particle size of about 40 to 1000 microns, preferably from about 40 to 400 microns. For purposes of this FIG. 7, the solid particles will be referred to coke, or coke particles.

A fluidizing gas e.g., steam, is introduced at the base of coker reactor 1, through line 16, in an amount sufficient to obtained superficial fluidizing velocity in the range of about 0.5 to 5 feet/second (0.15 to 1.5 m/s). Coke at a temperature above the coking temperature, for example, at a temperature from about 100° F. (38° C.) to about 400° F. (204° C.), preferably from about 150° F. (65° C.) to about 350° F. (177° C.), and more preferably from about 150° F. (65° C.) to 250° F. (121), in excess of the actual operating temperature of the coking zone is admitted to reactor 1 by line 17 from heater 2 in an amount sufficient to maintain the coking temperature in the range of about 850° F. (454° C.) to about 1200° F. (650° C.). The pressure in the coking zone is maintained in the range of about 0 to 150 psig (1030 kPag), preferably in the range of about 5 psig (34 kPag) to 45 psig (310 kPag). The lower portion of the coking reactor serves as a stripping zone 5 in which occluded hydrocarbons are removed from the coke by use of a stripping agent, such as steam, as the coke particles move through the stripping zone. A stream of stripped coke is withdrawn from the stripping zone 5 via line 18 and conducted to heater 2. Conversion products of the coking zone are passed through cyclone(s) 20 where entrained solids are removed and returned to coking zone 12 via dipleg 22. The resulting vapors exit cyclone 20 via line 24, and pass into a scrubber 25 mounted at the top of the coking reactor 1. The vapors passed into scrubber 25 are cooled and the heaviest components can be condensed. If desired, a stream of heavy materials condensed in the scrubber may be recycled to the coking reactor via line 26. Additionally or alternately, at least a portion of the heaviest components from the scrubber (i.e., coker bottoms) can be combined with a catalytic slurry oil for use as a feed for optional deasphalting and subsequent hydrotreating. Coker conversion products are removed from scrubber 25 via line 28 for fractionation in a conventional manner. In heater 2, stripped coke from coking reactor 1 (cold coke) is introduced via line 18 into a fluidized bed of hot coke having an upper level indicated at 30. The bed is heated by passing a fuel gas and/or air into the heater via line 32. The gaseous effluent of the heater, including entrained solids, passes through one or more cyclones which may include first cyclone(s) 34 and second cyclone(s) 36 wherein the separation of the larger entrained solids occur. The separated larger solids are returned to the heater via cyclone diplegs 38. The heated gaseous effluent that contains entrained solids is removed from heater 2 via line 40. Excess coke can be removed from heater 2 via line 42. A portion of hot coke is removed from the fluidized bed in heater 2 and recycled to coking reactor 1 via line 17 to supply heat to the coking zone. Although a gasifier can also be present as part of a coking reaction system, a gasifier is not shown in FIG. 7.

Delayed coking is another process suitable for the thermal conversion of heavy oils such as petroleum residua (also referred to as "resid") to produce liquid and vapor hydrocarbon products and coke. Delayed coking of resids from heavy and/or sour (high sulfur) crude oils is carried out by converting part of the resids to more valuable hydrocarbon products. The resulting coke has value, depending on its grade, as a fuel (fuel grade coke), electrodes for aluminum manufacture (anode grade coke), etc.

Generally, a residue fraction, such as a petroleum residuum feed is pumped to a pre-heater at a pressure of about 50 psig (345 kPag) to about 550 psig (3.7 MPag), where it is pre-heated to a temperature from about 480° C. to about 520° C. The pre-heated feed is conducted to a coking zone, typically a vertically-oriented, insulated coker vessel, e.g., drum, through an inlet at the base of the drum. Pressure in the drum is usually relatively low, such as about 15 psig (103 kPag) to about 80 psig (551 kPag) to allow volatiles to be removed overhead. Typical operating temperatures of the drum will be between about 410° C. and about 475° C. The hot feed thermally cracks over a period of time (the "coking time") in the coker drum, liberating volatiles composed primarily of hydrocarbon products that continuously rise through the coke mass and are collected overhead. The volatile products are conducted to a coker fractionator for distillation and recovery of coker gases, gasoline boiling range material such as coker naphtha, light gas oil, and heavy gas oil. In an embodiment, a portion of the heavy coker gas oil present in the product stream introduced into the coker fractionator can be captured for recycle and combined with the fresh feed (coker feed component), thereby forming the coker heater or coker furnace charge. Additionally or alternately, such a portion of the heavy coker gas oil can be combined with a catalytic slurry oil for use as a feed for optional deasphalting and subsequent hydrotreatment. In addition to the volatile products, the process also results in the accumulation of coke in the drum. When the coker drum is full of coke, the heated feed is switched to another drum and hydrocarbon vapors are purged from the coke drum with steam. The drum is then quenched with water to lower the temperature, after which the water is drained. When the cooling step is complete, the drum is opened and the coke is removed by drilling and/or cutting using high velocity water jets. The coke removal step is frequently referred to as "decoking".

Conventional coke processing aids can be used, including the use of antifoaming agents. The process is compatible with processes which use air-blown feed in a delayed coking process operated at conditions that will favor the formation of isotropic coke.

The volatile products from the coker drum are conducted away from the process for further processing. For example, volatiles can be conducted to a coker fractionator for distillation and recovery of coker gases, coker naphtha, light gas oil, and heavy gas oil. Such fractions can be used, usually but not always following upgrading, in the blending of fuel and lubricating oil products such as motor gasoline, motor diesel oil, fuel oil, and lubricating oil. Upgrading can include separations, heteroatom removal via hydrotreating and non-hydrotreating processes, de-aromatization, solvent extraction, and the like. Conventionally, at least a portion of the heavy coker gas oil present in the product stream introduced into the coker fractionator is captured for recycle and combined with the fresh feed (coker feed component), thereby forming the coker heater or coker furnace charge. The combined feed ratio ("CFR") is the volumetric ratio of furnace charge (fresh feed plus recycle oil) to fresh feed to the continuous delayed coker operation. Delayed coking operations typically employ recycles of about 5 vol. % to about 25 vol. % (CFRs of about 1.05 to about 1.25). In various aspects, instead of using this heavy coker gas oil (or coker bottoms) as a recycled feed portion to the coker, the coker bottoms can be used as a feed for optional deasphalting and hydrotreatment after combination with a catalytic slurry oil.

In an embodiment, pressure during pre-heat ranges from about 50 psig (345 kPag) to about 550 psig (3.8 MPag), and pre-heat temperature ranges from about 480° C. to about 520° C. Coking pressure in the drum ranges from about 15 psig (101 kPag) to about 80 psig (551 kPag), and coking temperature ranges from about 410° C. and 475° C. The coking time ranges from about 0.5 hour to about 24 hours.

Feedstock—Catalytic Slurry Oil

A catalytic slurry oil can correspond to a high boiling fraction, such as a bottoms fraction, from an FCC process. A variety of properties of a catalytic slurry oil can be characterized to specify the nature of a catalytic slurry oil feed.

One aspect that can be characterized corresponds to a boiling range of the catalytic slurry oil. Typically the cut point for forming a catalytic slurry oil can be at least about 650° F. (~343° C.). As a result, a catalytic slurry oil can have a T5 distillation (boiling) point or a T10 distillation point of at least about 288° C., or at least about 316° C., or at least about 650° F. (~343° C.), as measured according to ASTM D2887. In some aspects the D2887 10% distillation point (T10) can be greater, such as at least about 675° F. (~357° C.), or at least about 700° F. (~371° C.). In some aspects, a broader boiling range portion of FCC products can be used as a feed (e.g., a 350° F.+/~177° C.+ boiling range fraction of FCC liquid product), where the broader boiling range portion includes a 650° F.+ (~343° C.+) fraction that corresponds to a catalytic slurry oil. The catalytic slurry oil (650° F.+/~343° C.+) fraction of the feed does not necessarily have to represent a "bottoms" fraction from an FCC process, so long as the catalytic slurry oil portion comprises one or more of the other feed characteristics described herein.

In addition to and/or as an alternative to initial boiling points, T5 distillation point, and/or T10 distillation points, other distillation points may be useful in characterizing a feedstock. For example, a feedstock can be characterized based on the portion of the feedstock that boils above 1050° F. (~566° C.). In some aspects, a feedstock (or alternatively a 650° F.+/~343° C.+ portion of a feedstock) can have an ASTM D2887 T95 distillation point of 1050° F. (~566° C.) or greater, or a T90 distillation point of 1050° F. (~566° C.) or greater. If a feedstock or other sample contains components that are not suitable for characterization using D2887, ASTM D1160 may be used instead for such components.

In various aspects, density, or weight per volume, of the catalytic slurry oil can be characterized. The density of the catalytic slurry oil (or alternatively a 650° F.+/~343° C.+ portion of a feedstock) can be at least about 1.02 g/cm$^3$, or at least about 1.04 g/cm$^3$, or at least about 1.06 g/cm$^3$, or at least about 1.08 g/cm$^3$, such as up to about 1.20 g/cm$^3$. The density of the catalytic slurry oil can provide an indication of the amount of heavy aromatic cores that are present within the catalytic slurry oil.

Contaminants such as nitrogen and sulfur are typically found in catalytic slurry oils, often in organically-bound form. Nitrogen content can range from about 50 wppm to about 5000 wppm elemental nitrogen, or about 100 wppm to about 2000 wppm elemental nitrogen, or about 250 wppm to about 1000 wppm, based on total weight of the catalytic slurry oil. The nitrogen containing compounds can be present as basic or non-basic nitrogen species. Examples of nitrogen species can include quinolines, substituted quinolines, carbazoles, and substituted carbazoles.

The sulfur content of a catalytic slurry oil feed can be at least about 500 wppm elemental sulfur, based on total weight of the catalytic slurry oil. Generally, the sulfur content of a catalytic slurry oil can range from about 500 wppm to about 100,000 wppm elemental sulfur, or from about 1000 wppm to about 50,000 wppm, or from about 1000 wppm to about 30,000 wppm, based on total weight of the heavy component. Sulfur can usually be present as organically bound sulfur. Examples of such sulfur compounds include the class of heterocyclic sulfur compounds such as thiophenes, tetrahydrothiophenes, benzothiophenes and their higher homologs and analogs. Other organically bound sulfur compounds include aliphatic, naphthenic, and aromatic mercaptans, sulfides, di- and polysulfides.

Catalytic slurry oils can include n-heptane insolubles (NHI) or asphaltenes. In some aspects, the catalytic slurry oil feed (or alternatively a ~650° F.+/~343° C.+ portion of a feed) can contain at least about 1.0 wt % of n-heptane insolubles or asphaltenes, or at least about 2.0 wt %, or at least about 3.0 wt %, or at least about 5.0 wt %, such as up to about 10 wt % or more. In particular, the catalytic slurry oil feed (or alternatively a ~343° C.+ portion of a feed) can contain about 1.0 wt % to about 10 wt % of n-heptane insolubles or asphaltenes, or about 2.0 wt % to about 10 wt %, or about 3.0 wt % to about 10 wt %. Another option for characterizing the heavy components of a catalytic slurry oil can be based on the amount of micro carbon residue (MCR) in the feed. In various aspects, the amount of MCR in the catalytic slurry oil feed (or alternatively a ~343° C.+ portion of a feed) can be at least about 5 wt %, or at least about 8 wt %, or at least about 10 wt %, or at least about 12 wt %, such as up to about 20 wt % or more.

Based on the content of NHI and/or MCR in a catalytic slurry oil feed, the insolubility number (IN) for such a feed can be at least about 60, such as at least about 70, at least about 80, or at least about 90. Additionally or alternately, the IN for such a feed can be about 140 or less, such as about 130 or less, about 120 or less, about 110 or less, about 100 or less, about 90 or less, or about 80 or less. Each lower bound noted above for IN can be explicitly contemplated in conjunction with each upper bound noted above for IN. In particular, the IN for a catalytic slurry oil feed can be about 60 to about 140, or about 60 to about 120, or about 80 to about 140.

Catalyst fines can optionally be removed (such as partially removed to a desired level) by any convenient method, such as filtration. In some aspects, an improved method of removing particles from a blended feed can correspond to removing a portion of particles from the blended feed by settling, followed by using electrostatic filtration to remove additional particles.

Settling can provide a convenient method for removing larger particles from a feed. During a settling process, a feed can be held in a settling tank or other vessel for a period of time. This time period can be referred to as a settling time. The feed can be at a settling temperature during the settling time. While any convenient settling temperature can potentially be used (such as a temperature from about 20° C. to about 200° C.), a temperature of about 100° C. or greater (such as at least 105° C., or at least 110° C.) can be beneficial for allowing the viscosity of the blended feed to be low enough to facilitate settling. Additionally or alternately, the settling temperature can be about 200° C. or less, or about 150° C. or less, or about 140° C. or less. In particular, the settling temperature can be about 100° C. to about 200° C., or about 105° C. to about 150° C., or about 110° C. to about 140° C. The upper end of the settling temperature can be less important, and temperatures of still greater than 200° C. may also be suitable.

After the settling time, the particles can be concentrated in a lower portion of the settling tank. The blended feed including a portion of catalytic slurry oil and a portion of steam cracker tar can be removed from the upper portion of the settling tank while leaving the particle enriched bottoms in the tank. The settling process can be suitable for reducing the concentration of particles having a particle size of about 25 μm or greater from the blended feed.

After removing the larger particles from the blended feed, the blended feed can then be passed into an electrostatic separator. An example of a suitable electrostatic separator can be a Gulftronic™ electrostatic separator available from General Atomic. An electrostatic separator can be suitable for removal of particles of a variety of sizes, including both larger particles as well as particles down to a size of about 5 μm or less or even smaller. However, it can be beneficial to remove larger particles using a settling process to reduce or minimize the accumulation of large particles in an electrostatic separator. This can reduce the amount of time required for flush and regeneration of an electrostatic separator.

In an electrostatic separator, dielectric beads within the separator can be charged to polarize the dielectric beads. A fluid containing particles for removal can then be passed into the electrostatic separator. The particles can be attracted to the dielectric beads, allowing for particle removal. After a period of time, the electrostatic separator can be flushed to allow any accumulated particles in the separator to be removed.

In various aspects, an electrostatic separator can be used in combination with a settling tank for particle removal. Performing electrostatic separation on an blended feed effluent from a settling tank can allow for reduction of the number of particles in a blended feed to about 500 wppm or less, or about 100 wppm or less, or about 50 wppm or less, such as down to about 20 wppm or possibly lower. In particular, the concentration of particles in the blended feed after electrostatic separation can be about 0 wppm to about 500 wppm, or about 0 wppm to about 100 wppm, or about 0 wppm to about 50 wppm, or about 1 wppm to about 20 wppm. In some aspects, a single electrostatic separation stage can be used to reduce the concentration of particles in the blended feed to a desired level. In some aspects, two or more electrostatic separation stages in series can be used to achieve a target particle concentration.

Additional Feedstocks

In some aspects, at least a portion of a feedstock for processing as described herein can correspond to a vacuum resid fraction or another type 950° F.+ (510° C.+) or 1000° F.+ (538° C.+) fraction. Another example of a method for forming a 950° F.+ (510° C.+) or 1000° F.+ (538° C.+) fraction is to perform a high temperature flash separation.

The 950° F.+ (510° C.+) or 1000° F.+ (538° C.+) fraction formed from the high temperature flash can be processed in a manner similar to a vacuum resid.

A vacuum resid fraction or a 950° F.+ (510° C.+) fraction formed by another process (such as a flash fractionation bottoms or a bitumen fraction) can be deasphalted at low severity to form a deasphalted oil. Optionally, the feedstock can also include a portion of a conventional feed for lubricant base stock production, such as a vacuum gas oil.

A vacuum resid (or other 510° C.+) fraction can correspond to a fraction with a T5 distillation point (ASTM D2892, or ASTM D7169 if the fraction will not completely elute from a chromatographic system) of at least about 900° F. (482° C.), or at least 950° F. (510° C.), or at least 1000° F. (538° C.). Alternatively, a vacuum resid fraction can be characterized based on a T10 distillation point (ASTM D2892/D7169) of at least about 900° F. (482° C.), or at least 950° F. (510° C.), or at least 1000° F. (538° C.).

Resid (or other 510° C.+) fractions can be high in metals. For example, a resid fraction can be high in total nickel, vanadium and iron contents. In an aspect, a resid fraction can contain at least 0.00005 grams of Ni/V/Fe (50 wppm) or at least 0.0002 grams of Ni/V/Fe (200 wppm) per gram of resid, on a total elemental basis of nickel, vanadium and iron. In other aspects, the heavy oil can contain at least 500 wppm of nickel, vanadium, and iron, such as up to 1000 wppm or more.

Contaminants such as nitrogen and sulfur are typically found in resid (or other 510° C.+) fractions, often in organically-bound form. Nitrogen content can range from about 50 wppm to about 10,000 wppm elemental nitrogen or more, based on total weight of the resid fraction. Sulfur content can range from 500 wppm to 100,000 wppm elemental sulfur or more, based on total weight of the resid fraction, or from 1000 wppm to 50,000 wppm, or from 1000 wppm to 30,000 wppm.

Still another method for characterizing a resid (or other 510° C.+) fraction is based on the Conradson carbon residue (CCR) of the feedstock. The Conradson carbon residue of a resid fraction can be at least about 10 wt % or at least about 20 wt %. Additionally or alternately, the Conradson carbon residue of a resid fraction can be about 50 wt % or less, such as about 40 wt % or less or about 30 wt % or less.

In some aspects, a vacuum gas oil fraction can be co-processed with a deasphalted oil. The vacuum gas oil can be combined with the deasphalted oil in various amounts ranging from 20 parts (by weight) deasphalted oil to 1 part vacuum gas oil (i.e., 20:1) to 1 part deasphalted oil to 1 part vacuum gas oil. In some aspects, the ratio of deasphalted oil to vacuum gas oil can be at least 1:1 by weight, or at least 1.5:1, or at least 2:1. Typical (vacuum) gas oil fractions can include, for example, fractions with a T5 distillation point to T95 distillation point of 650° F. (343° C.)-1050° F. (566° C.), or 650° F. (343° C.)-1000° F. (538° C.), or 650° F. (343° C.)-950° F. (510° C.), or 650° F. (343° C.)-900° F. (482° C.), or ~700° F. (370° C.)-1050° F. (566° C.), or ~700° F. (370° C.)-1000° F. (538° C.), or ~700° F. (370° C.)-950° F. (510° C.), or ~700° F. (370° C.)-900° F. (482° C.), or 750° F. (399° C.)-1050° F. (566° C.), or 750° F. (399° C.)-1000° F. (538° C.), or 750° F. (399° C.)-950° F. (510° C.), or 750° F. (399° C.)-900° F. (482° C.). For example a suitable vacuum gas oil fraction can have a T5 distillation point of at least 343° C. and a T95 distillation point of 566° C. or less; or a T10 distillation point of at least 343° C. and a T90 distillation point of 566° C. or less; or a T5 distillation point of at least 370° C. and a T95 distillation point of 566° C. or less; or a T5 distillation point of at least 343° C. and a T95 distillation point of 538° C. or less.

In some aspects, at least a portion of a feedstock for processing as described herein can correspond to a deasphalter residue or rock fraction from deasphalting under low yield and/or propane deasphalting conditions. Low yield deasphalting can corresponding to performing deasphalting on a feed to generate a yield of deasphalted oil of 40 wt % or less, or 35 wt % or less, or 30 wt % or less, such as down to about 15 wt % or possibly lower. When deasphalting is performed at low yield to generate a deasphalter residue, a second deasphalting process can potentially be used to separate a resin fraction from a remaining portion of the deasphalter residue. Such a resin fraction can be processed along with other types of deasphalted oils generated from high yield deasphalting processes.

Solvent Deasphalting

Solvent deasphalting is a solvent extraction process. In some aspects, suitable solvents for high yield deasphalting methods as described herein include alkanes or other hydrocarbons (such as alkenes) containing 4 to 7 carbons per molecule, or 5 to 7 carbons per molecule. Examples of suitable solvents include n-butane, isobutane, n-pentane, $C_4$+ alkanes, $C_5$+ alkanes, $C_4$+ hydrocarbons, and $C_5$+ hydrocarbons. In some aspects, suitable solvents for low yield deasphalting can include $C_3$ hydrocarbons, such as propane, or alternatively $C_3$ and/or $C_4$ hydrocarbons. Examples of suitable solvents for low yield deasphalting include propane, n-butane, isobutane, n-pentane, $C_3$+ alkanes, $C_4$+ alkanes, $C_3$+ hydrocarbons, and $C_4$+ hydrocarbons.

In this discussion, a solvent comprising $C_n$ (hydrocarbons) is defined as a solvent composed of at least 80 wt % of alkanes (hydrocarbons) having n carbon atoms, or at least 85 wt %, or at least 90 wt %, or at least 95 wt %, or at least 98 wt %. Similarly, a solvent comprising $C_{n+}$ (hydrocarbons) is defined as a solvent composed of at least 80 wt % of alkanes (hydrocarbons) having n or more carbon atoms, or at least 85 wt %, or at least 90 wt %, or at least 95 wt %, or at least 98 wt %.

In this discussion, a solvent comprising $C_n$ alkanes (hydrocarbons) is defined to include the situation where the solvent corresponds to a single alkane (hydrocarbon) containing n carbon atoms (for example, n=3, 4, 5, 6, 7) as well as the situations where the solvent is composed of a mixture of alkanes (hydrocarbons) containing n carbon atoms. Similarly, a solvent comprising $C_{n+}$ alkanes (hydrocarbons) is defined to include the situation where the solvent corresponds to a single alkane (hydrocarbon) containing n or more carbon atoms (for example, n=3, 4, 5, 6, 7) as well as the situations where the solvent corresponds to a mixture of alkanes (hydrocarbons) containing n or more carbon atoms. Thus, a solvent comprising $C_{4+}$ alkanes can correspond to a solvent including n-butane; a solvent include n-butane and isobutane; a solvent corresponding to a mixture of one or more butane isomers and one or more pentane isomers; or any other convenient combination of alkanes containing 4 or more carbon atoms. Similarly, a solvent comprising $C_{5+}$ alkanes (hydrocarbons) is defined to include a solvent corresponding to a single alkane (hydrocarbon) or a solvent corresponding to a mixture of alkanes (hydrocarbons) that contain 5 or more carbon atoms. Alternatively, other types of solvents may also be suitable, such as supercritical fluids. In various aspects, the solvent for solvent deasphalting can consist essentially of hydrocarbons, so that at least 98 wt % or at least 99 wt % of the solvent corresponds to compounds containing only carbon and hydrogen. In aspects where the deasphalting solvent corresponds to a $C_{4+}$ deasphalting solvent, the $C_{4+}$ deasphalting solvent can include less than 15 wt % propane and/or other $C_3$ hydrocarbons, or less than 10 wt %, or less than 5 wt %, or the $C_{4+}$ deasphalting solvent can be substantially free of propane and/or other $C_3$ hydrocarbons (less than 1 wt %). In aspects where the deasphalting solvent corresponds to a $C_{5+}$ deasphalting solvent, the $C_{5+}$ deasphalting solvent can include less than 15 wt % propane, butane and/or other $C_3$-$C_4$ hydrocarbons, or less than 10 wt %, or less than 5 wt %, or the $C_{5+}$ deasphalting solvent can be substantially free of propane, butane, and/or other $C_3$-$C_4$ hydrocarbons (less than 1 wt %).

Deasphalting of heavy hydrocarbons, such as vacuum resids, is known in the art and practiced commercially. A deasphalting process typically corresponds to contacting a heavy hydrocarbon with an alkane solvent (propane, butane, pentane, hexane, heptane etc and their isomers), either in pure form or as mixtures, to produce two types of product streams. One type of product stream can be a deasphalted oil extracted by the alkane, which is further separated to produce deasphalted oil stream. A second type of product stream can be a residual portion of the feed not soluble in the solvent, often referred to as rock or asphaltene fraction. The deasphalted oil fraction can be further processed into make fuels or lubricants. The rock fraction can be further used as blend component to produce asphalt, fuel oil, and/or other products. The rock fraction can also be used as feed to gasification processes such as partial oxidation, fluid bed combustion or coking processes. The rock can be delivered to these processes as a liquid (with or without additional components) or solid (either as pellets or lumps).

In addition to performing a separation on liquid portions of a feed, solvent deasphalting of a feed that includes a catalytic slurry oil can also be beneficial for separation of catalyst fines. FCC processing of a feed can tend to result in production of catalyst fines based on the catalyst used for the FCC process. These catalyst fines typically are segregated into the catalytic slurry oil fraction generated from an FCC process. During solvent deasphalting, any catalyst fines present in the feed to solvent deasphalting can tend to be incorporated into the deasphalter residue phase. As a result, the catalyst fines content (any catalyst particles of detectable size) of a deasphalted oil generated by solvent deasphalting can be less than about 10 wppm., or less than about 1.0 wppm. By contrast, the feed to solvent deasphalting can contain at least 10 wppm of catalyst fines, or at least 100 wppm, or possibly more.

Solvent deasphalting can also be beneficial for generating a deasphalted oil having a reduced insolubility number ($I_N$) relative to the $I_N$ of the feed to the deasphalting process. Producing a deasphalted oil having a reduced $I_N$ can be beneficial, for example, for allowing improved operation of downstream processes. For example, a suitable type of processing for a heavy hydrocarbon feed can be hydroprocessing under trickle bed conditions. Hydroprocessing of a feed can provide a variety of benefits, including reduction of undesirable heteroatoms and modification of various flow properties of a feed. Conventionally, however, feeds having an $I_N$ of greater than about 50 have been viewed as unsuitable for fixed bed (such as trickle bed) hydroprocessing. Catalytic slurry oils (prior to solvent deasphalting) are an example of a feed that can typically have an $I_N$ of greater than about 50. This conventional view can be due to the belief that feeds with an $I_N$ of greater than about 50 are likely to cause substantial formation of coke within a reactor, leading to rapid plugging of a fixed reactor bed. However, it has been unexpectedly discovered that deasphalting of a feed including (or substantially composed of) a catalytic slurry oil, even at high lift values of about 80 wt % deasphalted oil yield or greater, or about 90 wt % or greater, or 94 wt % or greater (such as up to 99 wt % or more), can generate a deasphalted oil that is suitable for processing under a variety of fixed bed conditions with only a moderate or typical level of coke formation. This can be due in part to the reduced $I_N$ value of the deasphalted oil generated by deasphalting, relative to the $I_N$ value of the initial feed containing catalytic slurry oil. In other words, even when the amount of deasphalter residue (or rock) generated by a solvent deasphalting process performed on a feed containing catalytic slurry oil is less than 20 wt % relative to the feed, or less than 10 wt %, or less than 6 wt % (such as down to 1 wt % or less), the deasphalting process can still generate a deasphalted oil with an $I_N$ value of less than 50, or less than 40, or less than 30 (such as down to 10 or less).

The deasphalted oil produced by solvent deasphalting can also have a reduced asphaltene content and/or reduced micro carbon residue (MCR) content relative to the feed. For example, for a feed that is substantially composed of catalytic slurry oil, such as a feed containing at least 60 wt % of a catalytic slurry oil, or at least 75 wt %, in some aspects the n-heptane insolubles (asphaltene) content of the feed can be about 0.3 wt % or more, or about 1.0 wt % or more, or about 3.0 wt % or more, or about 5.0 wt % or more, such as up to about 10 wt % or possibly still higher. After solvent deasphalting, the amount of n-heptane insolubles can be about 0.2 wt % or less, or about 0.1 wt % or less, or about 0.05 wt % or less, such as down to 0.01 wt % or still lower. More generally, for a feed containing at least 10 wt % catalytic slurry oil, a ratio of the weight percent of n-heptane insolubles in the deasphalted oil relative to the weight percent of n-heptane insolubles in the feed can be about 0.5 or less, or about 0.3 or less, or about 0.1 or less, such as down to about 0.01 or still lower. Additionally or alternately, for a feed that is substantially composed of catalytic slurry oil, such as a feed containing at least 60 wt % of a catalytic slurry oil, or at least 75 wt %, in some aspects the MCR content of the feed can be about 8.0 wt % or more, or about 10 wt % or more, such as up to about 16 wt % or possibly still higher. After solvent deasphalting, the MCR content can be about 7.0 wt % or less, or about 5.0 wt % or less, such as down to 0.1 wt % or still lower. More generally, for a feed containing at least 10 wt % catalytic slurry oil, a ratio of the MCR content in the deasphalted oil relative to the MCR content in the feed can be about 0.8 or less, or about 0.6 or less, or about 0.4 or less, such as down to about 0.1 or still lower. In some aspects, the MCR content of the deasphalted oil can be 4.0 wt % or more, or 5.0 wt % or more, or 6.0 wt % or more, or 6.5 wt % or more, such as up to 7.0 wt %.

It is noted that the MCR content in DAO made from catalytic slurry oil (CSO) is comprised largely of molecules boiling between about 750° F. (~399° C.) and about 1050° F. (~566° C.). This type of MCR is unusual. Without being bound by any particular theory, it has been discovered that this unusual MCR may not continue to fully correspond to MCR when a CSO DAO is blended with another heavy feed fraction. As an example, a CSO DAO with a MCR of 7 is blended 50:50 with a virgin vacuum gasoil with an MCR of 0.2. The MCR of the blend is <0.5. The MCR in the blend is significantly less than the sum of the MCR in the two feedstocks. Based on the boiling range of a catalytic slurry oil, a deasphalted oil formed from a catalytic slurry oil can tend to have a reduced or minimized amount of 566° C.+ content, such as 7.0 wt % or less of 566° C.+ compounds, or 5.0 wt % or less.

Solvent deasphalting of a catalytic slurry oil and/or a feed including a substantial portion of catalytic slurry oil can also generate a deasphalted oil with an unexpectedly low API gravity. In various aspects, the API gravity at 15° C. of a deasphalted oil derived from a feed containing a catalytic slurry oil can be 0 or less, or −2.0 or less, or −5.0 or less, such as down to −15 or still low. The hydrogen content of a desaphalted oil derived from a catalytic slurry oil can also be low. For example, the hydrogen content of such a deasphalted oil can be about 7.5 wt % or less, or about 7.35 wt % or less, or about 7.0 wt % or less, such as down to 6.3 wt % or still lower. The $S_{BN}$ of a deasphalted oil derived (at least in part) from a catalytic slurry oil can be about 80 or more, or about 90 or more, or about 100 or more. The corresponding $I_N$ can optionally be 30 or more.

Solvent deasphalting also generates a deasphalter residue or rock fraction. The rock generated from deasphalting a feed containing a catalytic slurry oil can have an unusually low hydrogen content. For example, for solvent deasphalting under conditions suitable for producing at least 80 wt % of deasphalted oil from a feed containing catalytic slurry oil, or at least 85 wt % of deasphalted oil, or at least 90 wt % of deasphalted oil, the corresponding rock can have a hydrogen content of 5.7 wt % or less, or 5.5 wt % or less, or 5.4 wt % or less, or 5.3 wt % or less, such as down to 5.0 wt % or still lower. The micro carbon residue content of the rock can be about 50 wt % or more, or about 55 wt % or more, or about 60 wt % or more, such as up to about 70 wt % or still higher. The rock generated from solvent deasphalting can be used, for example, as a feed for a coker. In some aspects, it has been unexpectedly discovered that the net MCR content of the deasphalted oil and the rock fraction can be less than the MCR content of the initial feed. In such aspects, a ratio of the combined MCR content in the deasphalted oil and residual fraction relative to the MCR content in the feed can be about 0.8 or less, or about 0.7 or less, or about 0.6 or less, such as down to about 0.4 or still lower.

Due to the separation of catalyst fines into the deasphalter rock, the rock fraction can also contain an elevated content of catalyst fines. In various aspects, the rock fraction can contain about 100 wppm of catalyst fines or more, or about 200 wppm or more, or about 500 wppm or more.

During solvent deasphalting, a resid boiling range feed (optionally also including a portion of a vacuum gas oil feed) can be mixed with a solvent. Portions of the feed that are soluble in the solvent are then extracted, leaving behind a residue with little or no solubility in the solvent. The portion of the deasphalted feedstock that is extracted with the solvent is often referred to as deasphalted oil. Typical solvent deasphalting conditions include mixing a feedstock fraction with a solvent in a weight ratio of from about 1:2 to about 1:10, such as about 1:8 or less. Typical solvent deasphalting temperatures range from 40° C. to 200° C., or 40° C. to 150° C., depending on the nature of the feed and the solvent. The pressure during solvent deasphalting can be from about 50 psig (~345 kPag) to about 1000 psig (~6900 kPag).

It is noted that the above solvent deasphalting conditions represent a general range, and the conditions will vary depending on the feed. For example, under typical deasphalting conditions, increasing the temperature can tend to reduce the yield while increasing the quality of the resulting deasphalted oil. Under typical deasphalting conditions, increasing the molecular weight of the solvent can tend to increase the yield while reducing the quality of the resulting deasphalted oil, as additional compounds within a resid fraction may be soluble in a solvent composed of higher molecular weight hydrocarbons. Under typical deasphalting conditions, increasing the amount of solvent can tend to increase the yield of the resulting deasphalted oil. As understood by those of skill in the art, the conditions for a particular feed can be selected based on the resulting yield of deasphalted oil from solvent deasphalting. In various aspects, the yield of deasphalted oil from solvent deasphalting with a $C_{4+}$ solvent can be at least 50 wt % relative to the weight of the feed to deasphalting, or at least 60 wt %, or at least 65 wt %, or at least 70 wt %, such as up to 95 wt % or more. In aspects where the feed to deasphalting includes a vacuum gas oil portion, the yield from solvent deasphalting can be characterized based on a yield by weight of a 950° F.+ (510° C.) portion of the deasphalted oil relative to the weight of a 510° C.+ portion of the feed. In such aspects where a $C_{4+}$ solvent is used, the yield of 510° C.+ deasphalted oil from solvent deasphalting can be at least 40 wt % relative to the weight of the 510° C.+ portion of the feed to deasphalting, or at least 50 wt %, or at least 60 wt % or at least 65 wt %, or at least 70 wt % (such as up to 95 wt % or more). Additionally or alternately, the total yield can be at least 80 wt %, or at least 90 wt %, or at least 96 wt % (such as up to 99 wt % or more). In aspects where a $C_{4-}$ solvent is used, the yield of 510° C.+ deasphalted oil from solvent deasphalting can be 50 wt % or less relative to the weight of the 510° C.+ portion of the feed to deasphalting, or 40 wt % or less, or 35 wt % or less (such as down to 20 wt % or still lower).

Hydroprocessing of Deasphalted Oil or of Combined Catalytic Slurry Oil and Coker Bottoms After any deasphalting, the deasphalted oil (and any additional fractions combined with the deasphalted oil) and/or the combined catalytic slurry oil/coker bottoms feed can undergo further processing to form a hydroprocessed effluent. This can include hydrotreatment and/or hydrocracking to remove heteroatoms (such as sulfur and/or nitrogen) to desired levels, reduce Conradson Carbon content, and/or provide viscosity index (VI) uplift. Additionally or alternately, the hydroprocessing can be performed to achieve a desired level of conversion of higher boiling compounds in the feed to fuels boiling range compounds. Depending on the aspect, a deasphalted oil can be hydroprocessed by demetallization, aromatics saturation, hydrotreating, hydrocracking, or a combination thereof.

In some aspects, the deasphalted oil and/or the combined catalytic slurry oil/coker bottoms (CSO/CB) feed can be hydrotreated and/or hydrocracked with little or no solvent extraction being performed prior to and/or after the deasphalting. As a result, the deasphalted oil feed or combined CSO/CB feed for hydrotreatment and/or hydrocracking can have a substantial aromatics content. In various aspects, the aromatics content of the deasphalted oil feed or combined CSO/CB feed can be at least 50 wt %, or at least 55 wt %, or at least 60 wt %, or at least 65 wt %, or at least 70 wt %, or at least 75 wt %, such as up to 90 wt % or more. Additionally or alternately, the saturates content of the deasphalted oil feed or combined CSO/CB feed can be 50 wt % or less, or 45 wt % or less, or 40 wt % or less, or 35 wt % or less, or 30 wt % or less, or 25 wt % or less, such as down to 10 wt % or less. In this discussion and the claims below, the aromatics content and/or the saturates content of a fraction can be determined based on ASTM D7419.

The reaction conditions during demetallization and/or hydrotreatment and/or hydrocracking of the deasphalted oil or of the combined CSO/CB feed can be selected to generate a desired level of conversion of a feed. Any convenient type of reactor, such as fixed bed (for example trickle bed) reactors can be used. Conversion of the feed can be defined in terms of conversion of molecules that boil above a temperature threshold to molecules below that threshold. The conversion temperature can be any convenient temperature, such as ~700° F. (370° C.) or 1050° F. (566° C.). The amount of conversion can correspond to the total conversion of molecules within the combined hydrotreatment and hydrocracking stages for the deasphalted oil or combined CSO/CB feed. Suitable amounts of conversion of molecules boiling above 1050° F. (566° C.) to molecules boiling below 566° C. include 30 wt % to 100 wt % conversion relative to 566° C., or 30 wt % to 90 wt %, or 30 wt % to 70 wt %, or 40 wt % to 90 wt %, or 40 wt % to 80 wt %, or 40 wt % to 70 wt %, or 50 wt % to 100 wt %, or 50 wt % to 90 wt %, or 50 wt % to 70 wt %. In particular, the amount of conversion relative to 566° C. can be 30 wt % to 100 wt %, or 50 wt % to 100 wt %, or 40 wt % to 90 wt %. Additionally or alternately, suitable amounts of conversion of molecules boiling above ~700° F. (370° C.) to molecules boiling below 370° C. include 10 wt % to 70 wt % conversion relative to 370° C., or 10 wt % to 60 wt %, or 10 wt % to 50 wt %, or 20 wt % to 70 wt %, or 20 wt % to 60 wt %, or 20 wt % to 50 wt %, or 30 wt % to 70 wt %, or 30 wt % to 60 wt %, or 30 wt % to 50 wt %. In particular, the amount of conversion relative to 370° C. can be 10 wt % to 70 wt %, or 20 wt % to 50 wt %, or 30 wt % to 60 wt %.

The hydroprocessed deasphalted oil and/or hydroprocessed CSO/CB effluent can also be characterized based on the product quality. In some aspects, prior to hydroprocessing, the deasphalted oil (and/or the feedstock) can have an organic sulfur content of 1.0 wt % or more, or 2.0 wt % or more. After hydroprocessing (hydrotreating and/or hydrocracking), the liquid ($C_3$+) portion of the hydroprocessed deasphalted oil/hydroprocessed effluent can have an organic sulfur content of about 5000 wppm (0.5 wt %) or less, or about 1000 wppm or less, or about 500 wppm or less, or about 100 wppm or less (such as down to ~0 wppm). Additionally or alternately, the hydroprocessed deasphalted oil/hydroprocessed effluent can have a nitrogen content of 200 wppm or less, or 100 wppm or less, or 50 wppm or less (such as down to ~0 wppm). Additionally or alternately, the liquid ($C_3$+) portion of the hydroprocessed deasphalted oil/hydroprocessed effluent can have a MCR content and/or Conradson Carbon residue content of 2.5 wt % or less, or 1.5 wt % or less, or 1.0 wt % or less, or 0.7 wt % or less, or 0.1 wt % or less, or 0.02 wt % or less (such as down to ~0 wt %). MCR content and/or Conradson Carbon residue content can be determined according to ASTM D4530. Further additionally or alternately, the effective hydroprocessing conditions can be selected to allow for reduction of the n-heptane asphaltene content of the liquid ($C_3$+) portion of the hydroprocessed deasphalted oil/hydroprocessed effluent to less than about 1.0 wt %, or less than about 0.5 wt %, or less than about 0.1 wt %, and optionally down to substantially no remaining n-heptane asphaltenes. The hydrogen content of the liquid ($C_3$+) portion of the hydroprocessed deasphalted oil/hydroprocessed effluent can be at least about 10.5 wt %, or at least about 11.0 wt %, or at least about 11.5 wt %, such as up to about 13.5 wt % or more.

In aspects where hydroprocessing is performed on the combined catalytic slurry oil and coker bottoms without prior deasphalting, the $I_N$ of the hydroprocessed effluent can be at least 10 lower than the $I_N$ of the deasphalted oil prior to hydroprocessing, or at least 20 lower.

The $I_N$ of the liquid ($C_3$+) portion of the hydroprocessed deasphalted oil can be about 75 or less, or about 60 or less, or about 50 or less, or about 40 or less, or about 25 or less, such as down to about 20, or down to about 0. In particular, the $I_N$ can be about 20 to about 75, or about 0 to about 60, or about 20 to about 50, or about 0 to about 75, or about 0 to about 40. Typical deasphalted oils have an $I_N$ value of <20. Deasphalting can selectively remove high $I_N$ molecules, while allowing the deasphalted oil to maintain a relatively high $S_{BN}$ value. A deasphalted oil derived from a catalytic slurry oil can have has an $S_{BN}$ of 150 to 200. A typical coker bottoms stream can have an $S_{BN}$ between 90 and 120. Deaspahlted oils derived from conventional vacuum resid fractions can have $S_{BN}$ values in a range from ~40 (from a waxy paraffinic vac resid) to ~150 (from a heavy oil vac resid). In some aspects, the deasphalted oils described herein, derived from a catalytic slurry oil in combination with coker bottoms and/or vacuum resid, can have an $S_{BN}$ of >120 and an $I_N$ of <20. At typical hydroprocessing conditions for hydroprocessing of a conventional deasphalted oil, $I_N$ will increase and $S_{BN}$ will decrease during the course of hydroprocessing. For a conventional heavy feed with a relatively small gap between $S_{BN}$ and $I_N$, this convergence of $S_{BN}$ and $I_N$ values during hydroprocessing can lead to precipitation of asphaltenes and/or coking of catalyst if even modest levels of feed conversion are performed. However, because of the unexpected discovery of the ability to use catalytic slurry oil and/or coker bottoms (optionally with vacuum resid) to form deasphalted oils with high $S_{BN}$ values in combination with low $I_N$ values, the deasphalted oils can be hydroprocessed at high levels of feed conversion without causing reactor plugging and/or fouling. In particular, the hydroprocessed deasphalted oils described herein can have $S_{BN}$ values of about 90 to about 140 while having $I_N$ values of 0 to about 70. It is noted that due to the desire to maintain a high $S_{BN}$ value in the deasphalted oil, heavier vacuum resid fractions can in some instances be preferable for use in the feed to deasphalting.

After hydroprocessing, the liquid ($C_3$+) portion of the hydroprocessed deasphalted oil/hydroprocessed effluent can have a volume of at least about 95% of the volume of the corresponding feed to hydroprocessing, or at least about 100% of the volume of the feed, or at least about 105%, or at least about 110%, such as up to about 150% of the volume. In particular, the yield of $C_3$+ liquid products can be about 95 vol % to about 150 vol %, or about 110 vol % to about 150 vol %. Optionally, the $C_3$ and $C_4$ hydrocarbons can be used, for example, to form liquefied propane or butane gas as a potential liquid product. Therefore, the $C_3$+ portion of the effluent can be counted as the "liquid" portion of the effluent product, even though a portion of the compounds in the liquid portion of the hydrotreated effluent may exit the hydrotreatment reactor (or stage) as a gas phase at the exit temperature and pressure conditions for the reactor.

In some aspects, the portion of the hydroprocessed effluent having a boiling range/distillation point of less than about 700° F. (~371° C.) can be used as a low sulfur fuel oil or blendstock for low sulfur fuel oil. In other aspects, such a portion of the hydroprocessed effluent can be used (optionally with other distillate streams) to form ultra low sulfur naphtha and/or distillate (such as diesel) fuel products, such as ultra low sulfur fuels or blendstocks for ultra low sulfur fuels. The portion having a boiling range/distillation point of at least about 700° F. (~371° C.) can be used as an ultra low sulfur fuel oil having a sulfur content of about 0.1 wt % or less or optionally blended with other distillate or fuel oil streams to form an ultra low sulfur fuel oil or a low sulfur fuel oil. In some aspects, at least a portion of the liquid hydrotreated effluent having a distillation point of at least about ~371° C. can be used as a feed for FCC processing. In still other aspects, the portion having a boiling range/distillation point of at least about 371° C. can be used as a feedstock for lubricant base oil production.

Optionally, a feed can initially be exposed to a demetallization catalyst prior to exposing the feed to a hydrotreating catalyst. Deasphalted oils can have metals concentrations (Ni+V+Fe) on the order of 10-100 wppm. A combined catalytic slurry oil/coker bottoms feed can include still higher levels of metals. Exposing a conventional hydrotreating catalyst to a feed having a metals content of 10 wppm or more can lead to catalyst deactivation at a faster rate than may be desirable in a commercial setting. Exposing a metal containing feed to a demetallization catalyst prior to the hydrotreating catalyst can allow at least a portion of the metals to be removed by the demetallization catalyst, which can reduce or minimize the deactivation of the hydrotreating catalyst and/or other subsequent catalysts in the process flow. Commercially available demetallization catalysts can be suitable, such as large pore amorphous oxide catalysts that may optionally include Group VI and/or Group VIII non-noble metals to provide some hydrogenation activity.

In various aspects, the deasphalted oil or CSO/CB feed can be exposed to a hydrotreating catalyst under effective hydrotreating conditions. The catalysts used can include conventional hydroprocessing catalysts, such as those comprising at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å (as determined by ASTM D4284); a surface area (as measured by the BET method) from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base stock) boiling range feed in a conventional manner may be used. Preferably, the support or carrier material is an amorphous support, such as a refractory oxide. Preferably, the support or carrier material can be free or substantially free of the presence of molecular sieve, where substantially free of molecular sieve is defined as having a content of molecular sieve of less than about 0.01 wt %.

The at least one Group VIII non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydroprocessing is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to herein, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane). The treat gas stream introduced into a reaction stage will preferably contain at least about 50 vol. % and more preferably at least about 75 vol. % hydrogen. Optionally, the hydrogen treat gas can be substantially free (less than 1 vol %) of impurities such as $H_2S$ and $NH_3$ and/or such impurities can be substantially removed from a treat gas prior to use.

Hydrogen can be supplied at a rate of from about 100 SCF/B (standard cubic feet of hydrogen per barrel of feed) (17 $Nm^3/m^3$) to about 10000 SCF/B (1700 $Nm^3/m^3$). Preferably, the hydrogen is provided in a range of from about 2000 SCF/B (340 $Nm^3/m^3$) to about 10000 SCF/B (1700 $Nm^3/m^3$). Hydrogen can be supplied co-currently with the input feed to the hydrotreatment reactor and/or reaction zone or separately via a separate gas conduit to the hydrotreatment zone.

The effective hydrotreating conditions can optionally be suitable for incorporation of a substantial amount of additional hydrogen into the hydrotreated effluent. During hydrotreatment, the consumption of hydrogen by the feed in order to form the hydrotreated effluent can correspond to at least about 1500 SCF/bbl (~260 $Nm^3/m^3$) of hydrogen, or at least about 1700 SCF/bbl (~290 $Nm^3/m^3$), or at least about 2000 SCF/bbl (~330 $Nm^3/m^3$), or at least about 2200 SCF/bbl (~370 $Nm^3/m^3$), such as up to about 5000 SCF/bbl (~850 $Nm^3/m^3$) or more. In particular, the consumption of hydrogen can be about 1500 SCF/bbl (~260 $Nm^3/m^3$) to about 5000 SCF/bbl (~850 $Nm^3/m^3$), or about 2000 SCF/bbl (~340 $Nm^3/m^3$) to about 5000 SCF/bbl (~850 $Nm^3/m^3$), or about 2200 SCF/bbl (~370 $Nm^3/m^3$) to about 5000 SCF/bbl (~850 $Nm^3/m^3$).

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag), or about 2.9 MPag to about 13.9 MPag (~400 to ~2000 psig); liquid hourly space velocities (LHSV) of 0.1 $hr^{-1}$ to 10 $hr^{-1}$, or 0.1 $hr^{-1}$ to 5.0 $hr^{-1}$; and a hydrogen treat gas rate of from about 430 to about 2600 $Nm^3/m^3$ (~2500 to ~15000 SCF/bbl), or about 850 to about 1700 $Nm^3/m^3$ (~5000 to –10000 SCF/bbl).

In various aspects, the deasphalted oil can be exposed to a hydrocracking catalyst under effective hydrocracking conditions. Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Examples of suitable acidic supports include acidic molecular sieves, such as zeolites or silicoaluminophophates. One example of suitable zeolite is USY, such as a USY zeolite with cell size of 24.30 Angstroms or less. Additionally or alternately, the catalyst can be a low acidity molecular sieve, such as a USY zeolite with a Si to Al ratio of at least about 20, and preferably at least about 40 or 50. ZSM-48, such as ZSM-48 with a $SiO_2$ to $Al_2O_3$ ratio of about 110 or less, such as about 90 or less, is another example of a potentially suitable hydrocracking catalyst. Still another option is to use a combination of USY and ZSM-48. Still other options include using one or more of zeolite Beta, ZSM-5, ZSM-35, or ZSM-23, either alone or in combination with a USY catalyst. Non-limiting examples of metals for hydrocracking catalysts include metals or combinations of metals that include at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

When only one hydrogenation metal is present on a hydrocracking catalyst, the amount of that hydrogenation metal can be at least about 0.1 wt % based on the total weight of the catalyst, for example at least about 0.5 wt % or at least about 0.6 wt %. Additionally or alternately when only one hydrogenation metal is present, the amount of that hydrogenation metal can be about 5.0 wt % or less based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less. Further additionally or alternately when more than one hydrogenation metal is present, the collective amount of hydrogenation metals can be at least about 0.1 wt % based on the total weight of the catalyst, for example at least about 0.25 wt %, at least about 0.5 wt %, at least about 0.6 wt %, at least about 0.75 wt %, or at least about 1 wt %. Still further additionally or alternately when more than one hydrogenation metal is present, the collective amount of hydrogenation metals can be about 35 wt % or less based on the total weight of the catalyst, for example about 30 wt % or less, about 25 wt % or less, about 20 wt % or less, about 15 wt % or less, about 10 wt % or less, or about 5 wt % or less. In embodiments wherein the supported metal comprises a noble metal, the amount of noble metal(s) is typically less than about 2 wt %, for example less than about 1 wt %, about 0.9 wt % or less, about 0.75 wt % or less, or about 0.6 wt % or less. It is noted that hydrocracking under sour conditions is typically performed using a base metal (or metals) as the hydrogenation metal.

In various aspects, the conditions selected for hydrocracking can depend on the desired level of conversion, the level of contaminants in the input feed to the hydrocracking stage, and potentially other factors. For example, hydrocracking conditions in a single stage, or in the first stage and/or the second stage of a multi-stage system, can be selected to achieve a desired level of conversion in the reaction system. Hydrocracking conditions can be referred to as sour conditions or sweet conditions, depending on the level of sulfur and/or nitrogen present within a feed. For example, a feed with 100 wppm or less of sulfur and 50 wppm or less of nitrogen, preferably less than 25 wppm sulfur and/or less than 10 wppm of nitrogen, represent a feed for hydrocracking under sweet conditions. In various aspects, hydrocracking can be performed on a thermally cracked resid, such as a deasphalted oil derived from a thermally cracked resid. In some aspects, such as aspects where an optional hydrotreating step is used prior to hydrocracking, the thermally cracked resid may correspond to a sweet feed. In other aspects, the thermally cracked resid may represent a feed for hydrocracking under sour conditions.

A hydrocracking process under sour conditions can be carried out at temperatures of about 550° F. (288° C.) to about 840° F. (449° C.), hydrogen partial pressures of from about 1500 psig to about 5000 psig (10.3 MPag to 34.6 MPag), liquid hourly space velocities of from 0.05 to and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 2140 $m^3/m^3$ (1200 SCF/B to 12000 SCF/B). The LHSV can be from about 0.25 $h^{-1}$ to about 50 $h^{-1}$, or from about 0.5 $h^{-1}$ to about 20 $h^{-1}$, preferably from about 1.0 $h^{-1}$ to about 4.0 $h^{-1}$.

In some aspects, a portion of the hydrocracking catalyst can be contained in a second reactor stage. In such aspects, a first reaction stage of the hydroprocessing reaction system can include one or more hydrotreating and/or hydrocracking catalysts. The conditions in the first reaction stage can be suitable for reducing the sulfur and/or nitrogen content of the feedstock. A separator can then be used in between the first and second stages of the reaction system to remove gas phase sulfur and nitrogen contaminants. One option for the separator is to simply perform a gas-liquid separation to remove contaminant. Another option is to use a separator such as a flash separator that can perform a separation at a higher temperature. Such a high temperature separator can be used, for example, to separate the feed into a portion boiling below a temperature cut point, such as about 350° F. (177° C.) or about 400° F. (204° C.), and a portion boiling above the temperature cut point. In this type of separation, the naphtha boiling range portion of the effluent from the first reaction stage can also be removed, thus reducing the volume of effluent that is processed in the second or other subsequent stages. Of course, any low boiling contaminants in the effluent from the first stage would also be separated into the portion boiling below the temperature cut point. If sufficient contaminant removal is performed in the first stage, the second stage can be operated as a "sweet" or low contaminant stage.

Still another option can be to use a separator between the first and second stages of the hydroprocessing reaction system that can also perform at least a partial fractionation of the effluent from the first stage. In this type of aspect, the effluent from the first hydroprocessing stage can be separated into at least a portion boiling below the distillate (such as diesel) fuel range, a portion boiling in the distillate fuel range, and a portion boiling above the distillate fuel range. The distillate fuel range can be defined based on a conventional diesel boiling range, such as having a lower end cut point temperature of at least about 350° F. (177° C.) or at least about 400° F. (204° C.) to having an upper end cut point temperature of about 700° F. (371° C.) or less or 650° F. (343° C.) or less. Optionally, the distillate fuel range can be extended to include additional kerosene, such as by selecting a lower end cut point temperature of at least about 300° F. (149° C.).

In aspects where the inter-stage separator is also used to produce a distillate fuel fraction, the portion boiling below the distillate fuel fraction includes, naphtha boiling range molecules, light ends, and contaminants such as $H_2S$. These different products can be separated from each other in any convenient manner. Similarly, one or more distillate fuel fractions can be formed, if desired, from the distillate boiling range fraction. The portion boiling above the distillate fuel range represents the potential lubricant base stocks. In such aspects, the portion boiling above the distillate fuel range is subjected to further hydroprocessing in a second hydroprocessing stage.

A hydrocracking process under sweet conditions can be performed under conditions similar to those used for a sour hydrocracking process, or the conditions can be different. In an embodiment, the conditions in a sweet hydrocracking stage can have less severe conditions than a hydrocracking process in a sour stage. Suitable hydrocracking conditions for a non-sour stage can include, but are not limited to, conditions similar to a first or sour stage. Suitable hydrocracking conditions can include temperatures of about 500° F. (260° C.) to about 840° F. (449° C.), hydrogen partial pressures of from about 1500 psig to about 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-}$, preferably from about 1.0 $h^{-1}$ to about 4.0 $h^{-1}$.

In still another aspect, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

In yet another aspect, a hydroprocessing reaction system may include more than one hydrocracking stage. If multiple hydrocracking stages are present, at least one hydrocracking stage can have effective hydrocracking conditions as described above, including a hydrogen partial pressure of at least about 1500 psig (10.3 MPag). In such an aspect, other hydrocracking processes can be performed under conditions that may include lower hydrogen partial pressures. Suitable hydrocracking conditions for an additional hydrocracking stage can include, but are not limited to, temperatures of about 500° F. (260° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions for an additional hydrocracking stage can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, and preferably from about 1.0 $h^{-1}$ to about 4.0 $h^{-1}$.

FCC—Creation of Catalytic Slurry Oil

A catalytic slurry oil used as a feed for the various processes described herein can correspond to a product from FCC processing. In particular, a catalytic slurry oil can correspond to a bottoms fraction and/or other fraction having a boiling range greater than a typical light cycle oil from an FCC process.

The properties of catalytic slurry oils suitable for use in some aspects are described above. In order to generate such suitable catalytic slurry oils, the FCC process used for generation of the catalytic slurry oil can be characterized based on the feed delivered to the FCC process. For example, performing an FCC process on a light feed, such as a feed that does not contain NHI or MCR components, can tend to result in an FCC bottoms product with an IN of less than about 50. Such an FCC bottoms product can be blended with other feeds for hydroprocessing via conventional techniques. By contrast, the processes described herein can provide advantages for processing of FCC fractions (such as bottoms fractions) that have an IN of greater than about 50, such as about 60 to 140, or about 70 to about 130.

In some aspects, a FCC bottoms fraction having an $I_N$ of greater than about 50 and/or an NHI of at least about 1 wt % and/or a MCR of at least about 4 wt % can be formed by performing FCC processing on a feed to generate a FCC bottoms fraction yield of about 3 wt % or more, or about 5 wt % or more, or about 7 wt % or more, such as up to 15 wt % or still higher. The FCC bottoms fraction yield can be defined as the yield of 650° F.+ (~343° C.+) product from the FCC process. Additionally or alternately, the FCC bottoms fraction can have any one or more of the other catalytic slurry oil feed properties described elsewhere herein.

Examples of Reaction System Configurations

FIG. 1 schematically shows an example of a reaction system for processing a feed including a catalytic slurry oil fraction and a coker bottoms fraction. In FIG. 1, a feed 102 is introduced into a fluid catalytic cracker 120. This results in generation of typical fluid catalytic cracking (FCC) products, such as light ends 122, naphtha boiling range fraction 124, and one or more cycle oils 126. Additionally, the FCC process generates a catalytic slurry oil 128 as a bottoms product. It is noted that the fluid catalytic cracker 120 shown in FIG. 1 is shown for completeness. In some aspects, at least a portion of catalytic slurry oil 128 can be catalytic slurry oil from a remote FCC process.

Also in FIG. 1, a feed 103 is introduced into a coker 130. This results in generation of typical coker products, such as light ends 132, a coker naphtha boiling range fraction 134, one or more coker gas oils 136, and coke 139. Additionally, the coking process generates a coker bottoms 138. Under conventional operation, coker bottoms 138 would be recycled back to coker 130. By contrast, in the configuration shown in FIG. 1, at least a portion of coker bottoms 138 is combined with catalytic slurry oil 128 for further processing. It is noted that the coker 130 shown in FIG. 1 is shown for completeness. In some aspects, at least a portion of coker bottoms 138 can be coker bottoms from a remote coking process.

The feed corresponding to a combination of catalytic slurry oil 128 and coker bottoms 138 can then be passed into a hydrotreater 150 (or other hydroprocessing unit) under effective hydrotreating conditions, such as fixed bed (including trickle bed) hydrotreating conditions, to produce a hydrotreated effluent 155. The hydrotreated effluent can be fractionated (not shown) to form, for example, one or more naphtha boiling range fractions, one or more distillate fuel boiling range fractions, and one or more heavier (gas oil) fractions. The heavier fraction(s) can potentially be used as a fuel oil and/or as a feed for an FCC reactor and/or as a feed for further processing for lubricant base oil production. Optionally, the one or more naphtha boiling range fractions can have a sufficiently low sulfur content for use in a fuel pool, or the fraction can be further hydroprocessed (not shown) to further reduce the sulfur content prior to use as a gasoline. Similarly, the one or more distillate fuel boiling range fractions can be suitable for incorporation into a distillate fuel pool, or the fraction can be further hydroprocessed (not shown) to form a low sulfur fuel product. The one or more distillate fuel boiling range fractions can correspond to kerosene fractions, jet fractions, and/or diesel fractions.

It is noted that the components shown in FIG. 1 can include various inlets and outlets that permit fluid communication between the components shown in FIG. 1. For example, a fluid catalytic cracker can include a fluid catalytic cracking (FCC) inlet and an FCC outlet; a hydroprocessor can include a hydroprocessor inlet and hydroprocessor outlet; a coker can include a coker inlet and a coker outlet; and a deasphalting unit can include a deasphalted oil outlet and a deasphalter residue outlet. The flow paths in FIG. 1 can represent fluid communication between the components. Fluid communication can refer to direct fluid communication or indirect fluid communication. Indirect fluid communication refers to fluid communication where one or more intervening process elements are passed through for fluids (and/or solids) that are communicated between the indirectly communicating elements.

In FIG. 1, the fluid catalytic cracker 120 and the coker 130 are shown as being in fluid communication with the hydrotreater 150. It is noted that fluid catalytic cracker 120 and/or coker 130 may have one or more associated temperature-based separation units or towers for generating the various fractions shown in FIG. 1. In the example shown in FIG. 1, it is noted that the coker bottoms fraction and FCC bottoms fractions are passed into hydrotreater 150 without intervening thermal and/or catalytic processing of the fractions. This is in contrast to a configuration such as FIG. 2, where the FCC bottoms fraction and/or the coker bottoms fraction are passed through a deasphalting unit prior to entering the hydrotreater. In a configuration similar to FIG. 2, the coker and fluid catalytic cracker can be considered to be in indirect fluid communication with the hydrotreater, due to the presence of the intervening solvent processing unit (i.e., solvent deasphalting unit 240).

Figure 2:
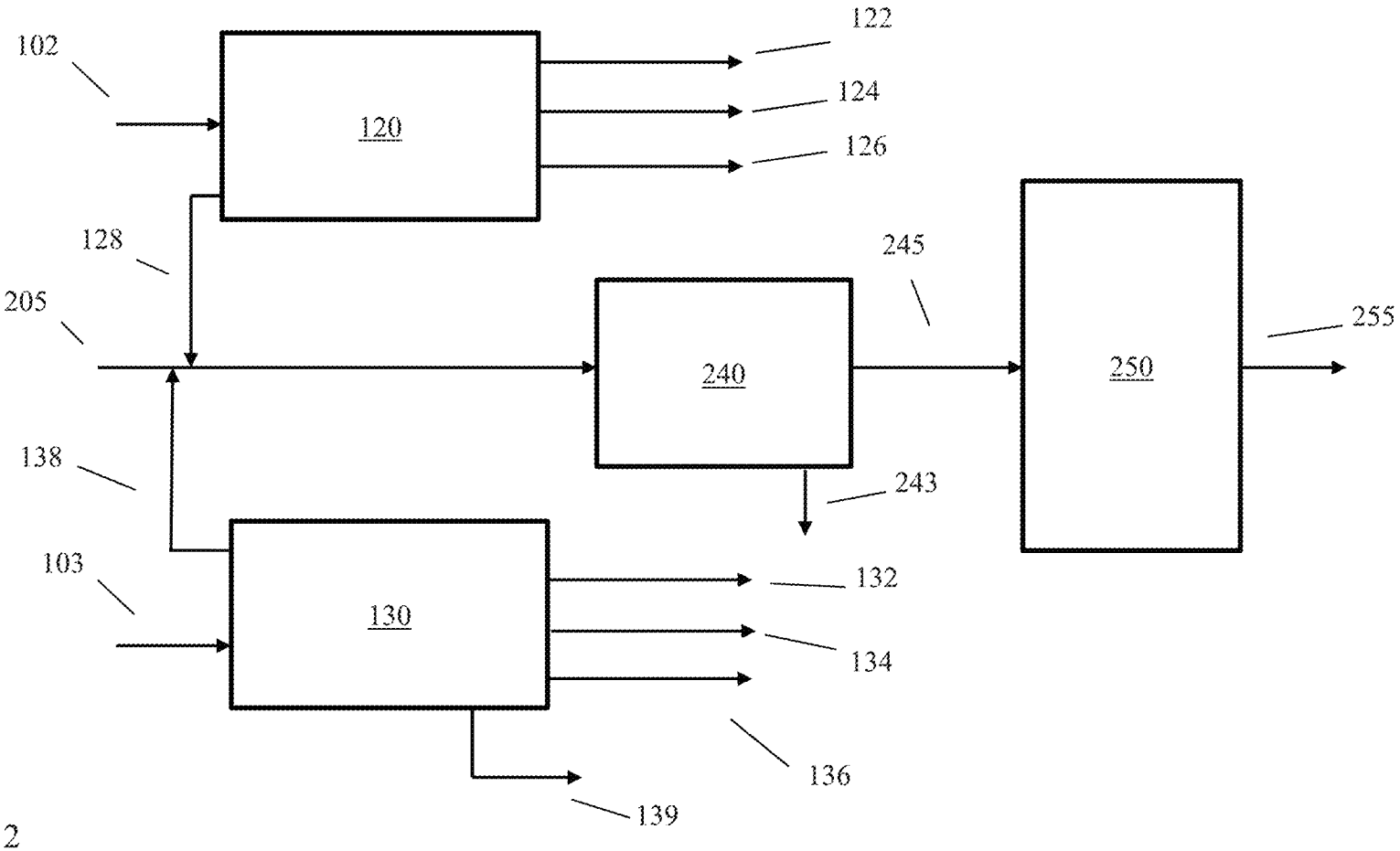
FIG. 2 shows another example of a reaction system for integrated processing of catalytic slurry oil and coker bottoms.

FIG. 2 shows another example of a configuration for hydroprocessing of a combined catalytic slurry oil and coker bottoms feed. In FIG. 2, a catalytic slurry oil 128 and coker bottoms 138 can be generated and/or otherwise provided as described in association with FIG. 1. Optionally, the catalytic slurry oil 128 and coker bottoms 138 can be combined with a vacuum gas oil and/or vacuum resid feed 205. The catalytic slurry oil 128 and coker bottoms 138 (and any additional optional feed components) can then be passed into solvent deasphalting unit 240. This results in formation of a deasphalted oil 245 and a deasphalter residue or rock 243. Preferably, deasphalter 240 can use a deasphalting solvent suitable for producing a yield of deasphalted oil of about 60 wt % or more, or about 70 wt % or more, or about 80 wt % or more, such as up to about 95 wt % or possibly still higher. The deasphalted oil 245 can then be passed into a hydrotreater 250 under effective hydrotreating conditions, such as fixed bed (including trickle bed) hydrotreating conditions, to produce a hydrotreated effluent 255. The hydrotreated effluent can be fractionated (not shown) to form, for example, one or more naphtha boiling range fractions, one or more distillate fuel boiling range fractions, and one or more heavier (gas oil) fractions. The heavier fraction(s) can potentially be used as a fuel oil and/or as a feed for an FCC reactor and/or as a feed for further processing for lubricant base oil production. Optionally, the one or more naphtha boiling range fractions can have a sufficiently low sulfur content for use in a fuel pool, or the fraction can be further hydroprocessed (not shown) to further reduce the sulfur content prior to use as a gasoline. Similarly, the one or more distillate fuel boiling range fractions can be suitable for incorporation into a distillate fuel pool, or the fraction can be further hydroprocessed (not shown) to form a low sulfur fuel product. The one or more distillate fuel boiling range fractions can correspond to kerosene fractions, jet fractions, and/or diesel fractions.

Figure 3:
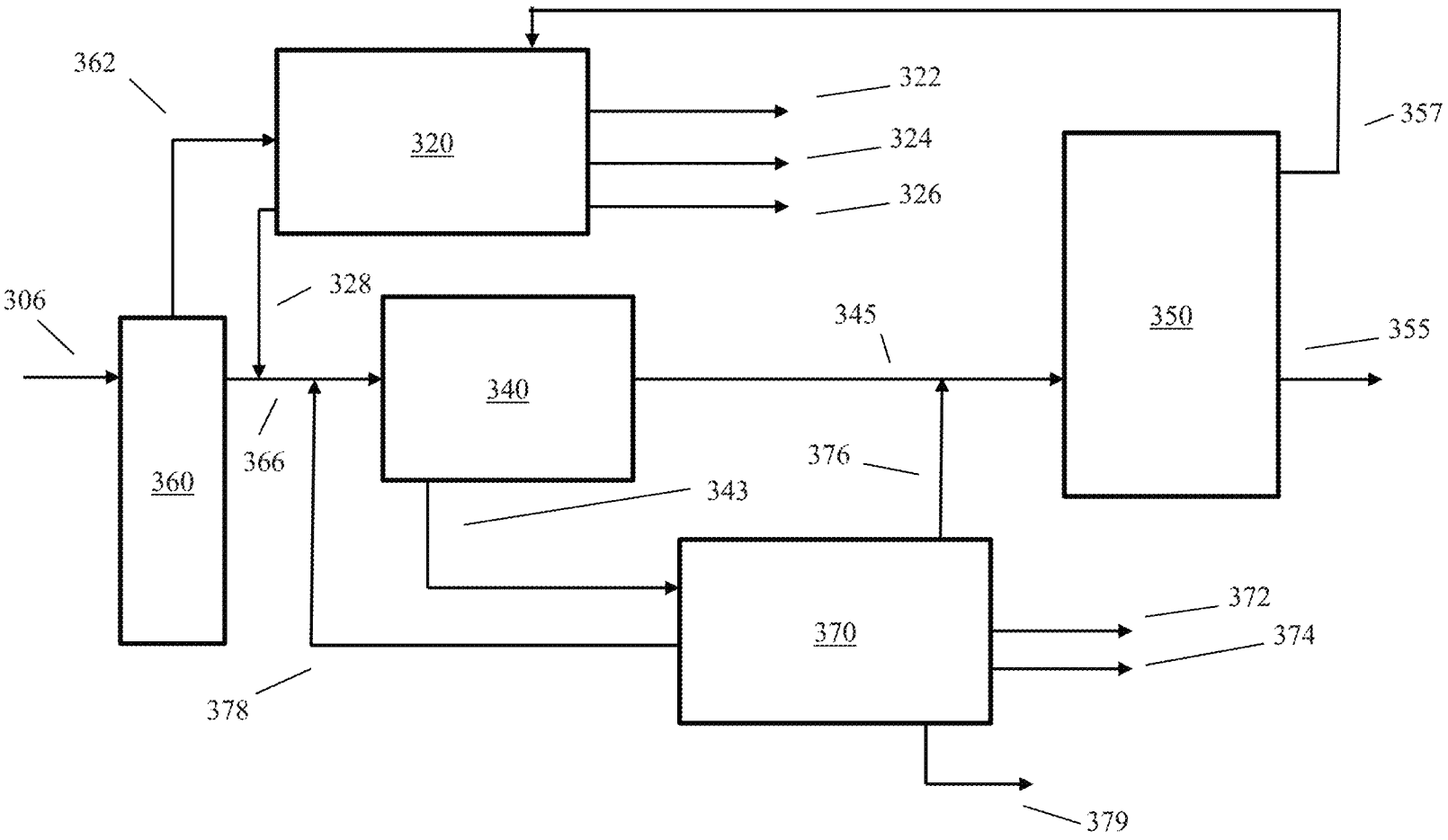
FIG. 3 shows an example of a reaction system for integration of deasphalting, coking, and hydroprocessing of a feedstock.

FIG. 3 shows yet another configuration for processing of a feed. In FIG. 3, the flows between processes are configured in a different manner that can allow for reduced flow rates into the coking process. For systems that are limited based on coker capacity, the configuration in FIG. 3 can provide an option for increasing the total feed processing capacity by reducing the amount of coker capacity required per barrel of feed.

In FIG. 3, a feed 306 having a 600° F.+ (316° C.+) fraction, such as an atmospheric resid, is passed into a vacuum distillation tower 360 or another suitable separation stage for forming a vacuum gas oil portion 362 and a vacuum resid portion 366. The vacuum gas oil portion 362 can have a T90 distillation point that is suitable for processing in a fluid catalytic cracking process, such as a T90 distillation point of 482° C. or less, or 510° C. or less, or 538° C. or less, or 566° C. or less. The T10 distillation point for the vacuum gas oil portion 362 can correspond to any convenient value based on the nature of the feed 306. In some aspects, the T10 distillation point can be about 316° C. or more, or about 343° C. or more, or about 370° C. or more. The vacuum resid portion 366 can correspond to a remaining or bottoms portion of feed 306 after separation of vacuum gas oil portion 362 from feed 306.

The vacuum gas oil portion 362 can be passed into a fluid catalytic cracker 320. Optionally, a hydrotreated vacuum gas oil fraction 357 from hydroprocessing unit 350 can also be recycled for inclusion as part of the feed to the fluid catalytic cracker 320. This results in generation of typical fluid catalytic cracking (FCC) products, such as light ends 322, naphtha boiling range fraction 324, and one or more cycle oils 326. Additionally, the FCC process generates a catalytic slurry oil 328 as a bottoms product. Optionally, catalytic slurry oil 328 can include additional catalytic slurry oil from other FCC processes that are not integrated with the system shown in FIG. 3 (including, but not limited to, FCC processes at remote locations). Optionally, fluid catalytic cracker 320 can be optional, with catalytic slurry oil 328 being derived from non-integrated FCC processes. In such an optional aspect, vacuum gas oil portion 362 can undergo any convenient type of further processing, such as processing to form lubricant base oils.

Instead of passing a vacuum resid feed into coker 370, the feed to the coker 370 corresponds to a deasphalter residue or rock fraction 343. In addition to reducing the net flow rate to the coker 370, using rock fraction 343 as the feed to coker 370 can reduce the total amount of coke generated by allowing other processes to handle portions of the feed that would otherwise be converted to coke. This results in generation of typical coker products, such as light ends 372, a coker naphtha boiling range fraction 374, and coke 379. In the configuration shown in FIG. 3, coker gas oil 376 can be added to the deasphalted oil 345 for further treatment in hydroprocessing unit 350. Additionally, the coking process generates a coker bottoms 378. Under conventional operation, coker bottoms 378 would be recycled back to coker 370. By contrast, in the configuration shown in FIG. 3, at least a portion of coker bottoms 378 is combined with catalytic slurry oil 328 for further processing. Optionally, additional coker bottoms from other non-integrated cokers (such as a coker in a remote location) can be included as part of coker bottoms 378.

The catalytic slurry oil 328, coker bottoms 378, and vacuum resid fraction 366 are passed into deasphalter 340. This results in formation of a deasphalted oil 345 and a deasphalter residue or rock 343. Preferably, deasphalter 340 can use a deasphalting solvent suitable for producing a yield of deasphalted oil of about 60 wt % or more, or about 70 wt % or more, or about 80 wt % or more, such as up to about 95 wt % or possibly still higher. The deasphalted oil 345 can then be passed into a hydrotreater 350 under effective hydrotreating conditions, such as fixed bed (including trickle bed) hydrotreating conditions, to produce a hydrotreated effluent 355. An example of a fraction that can be included in the hydrotreated effluent 355 is a hydrotreated vacuum gas oil fraction 357. The hydrotreated vacuum gas oil fraction 357 can be recycled back to fluid catalytic cracker 320, or the hydrotreated vacuum gas oil fraction 357 can undergo other further processing, such as further processing to form lubricant base oils.

Example 1—Solvent Deasphalting of Catalytic Slurry Oil

A catalytic slurry oil was exposed to various solvent deasphalting conditions with n-pentane as the deasphalting solvent for formation of deasphalted oil. It is noted that the viscosity of typical catalytic slurry oils can be lower than the viscosity of typical vacuum resid fractions. As a result, the yields of deasphalted oil generated under the conditions in this Example (e.g., roughly 90 wt % for the data shown in FIG. 2) were greater than typical yields that would be expected for deasphalting of a conventional vacuum resid feed (roughly 70 wt %).

Figure 5:
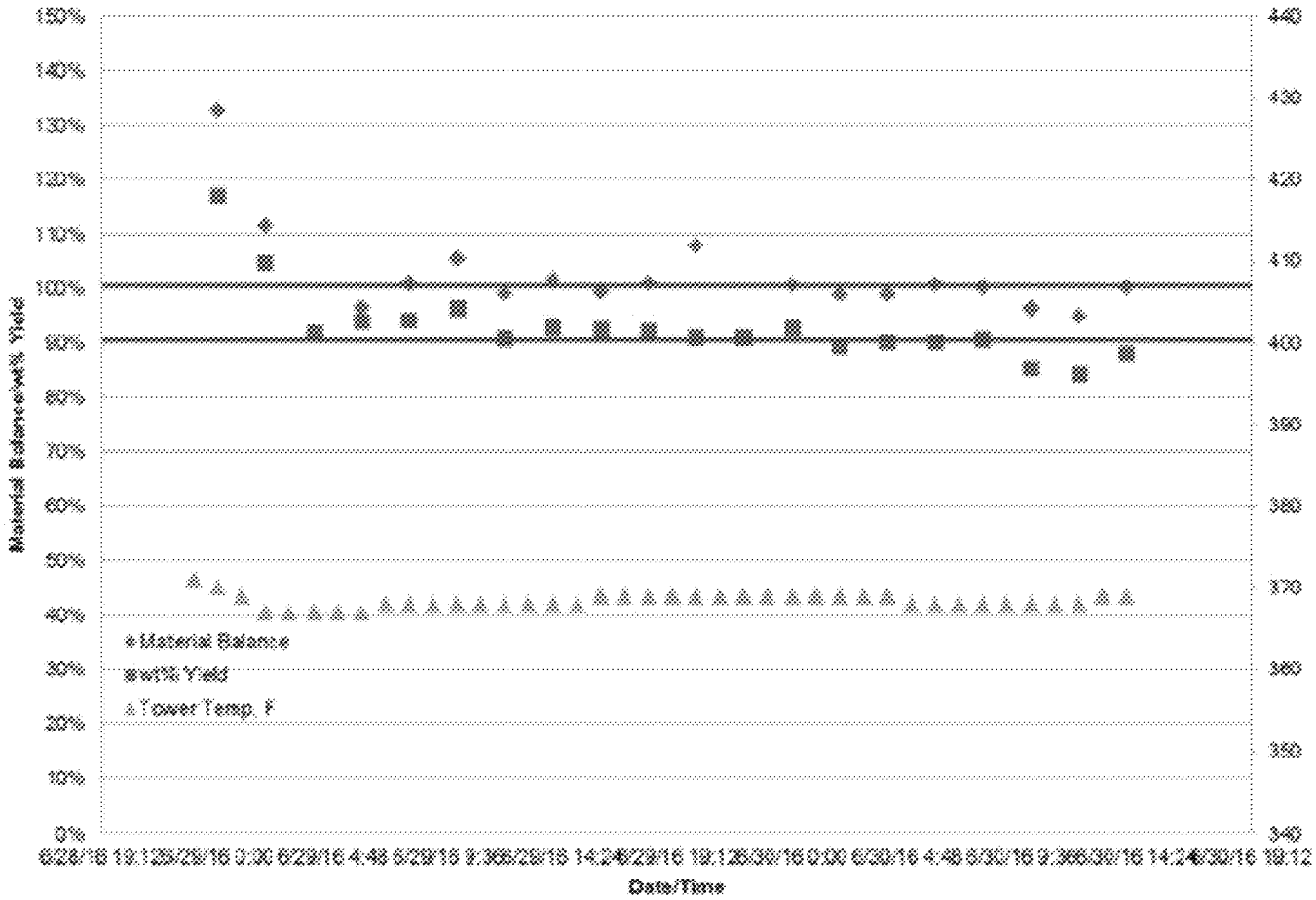
FIG. 5 shows results from performing solvent deasphalting on a feed comprising a catalytic slurry oil.
Figure 9:
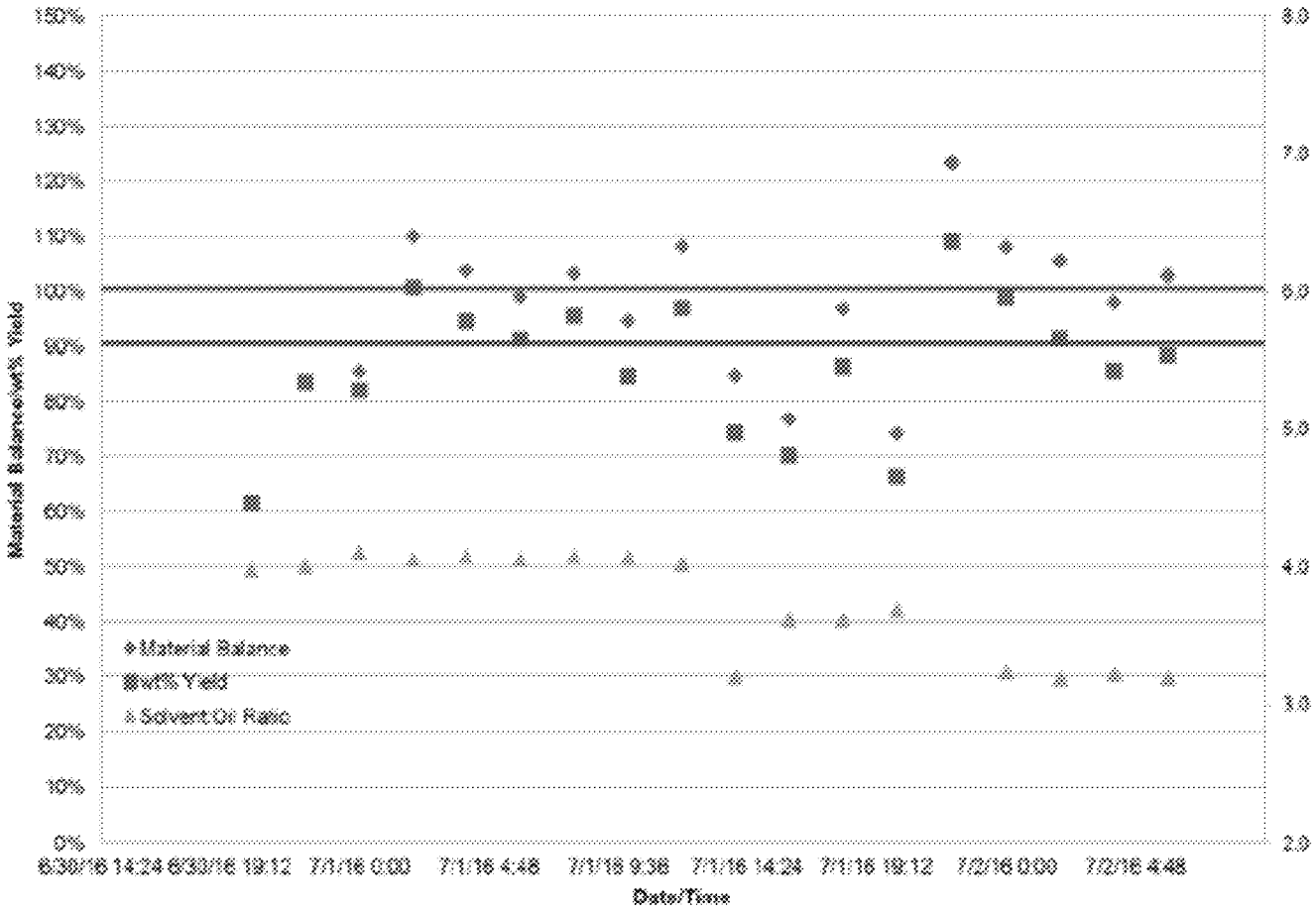

FIG. 5 shows results from solvent deasphalting at an n-pentane to catalytic slurry oil ratio of 6:1 (by volume) and a top tower temperature of ~369° F. (~187° C.). In FIG. 5, the right axis provides the temperature scale associated with the triangles. The left axis provides the wt % scale for evaluating the deasphalted oil yield (represented by squares) and the material balance of combined deasphalted oil and rock yield (represented by diamonds). As shown in FIG. 5, roughly a 90 wt % yield of deasphalted oil was achieved under the solvent deasphalting conditions.

FIG. 6 shows results from additional solvent deasphalting runs using different solvent to feed ratios. In FIG. 6, the triangles correspond to the ratio of n-pentane (solvent) to catalytic slurry oil (feed). The right axis provides the ratio scale for the triangle data points. The left axis corresponds to wt %, similar to FIG. 5. The top tower temperature was ~369° F. (~187° C.). FIG. 6 shows that yields of deasphalted oil of roughly 80 wt %-90 wt % were achieved at solvent to feed ratios of as low as 3:1.

Example 2—Properties of Catalytic Slurry Oils, Deasphalted Oils, and Rock

Catalytic slurry oils were obtained from fluid catalytic cracking (FCC) processes operating on various feeds. Table 1 shows results from characterization of the catalytic slurry oils. Additionally, a blend of catalytic slurry oils from several FCC process sources was also formed and characterized.

TABLE 1

Characterization of Catalytic Slurry Oils

| | CSO 1 | CSO 2 | CSO 3 | CSO 4 | CSO X (Blend) |
|---|---|---|---|---|---|
| API Gravity (15° C.) | −7.5 | −9.0 | 1.2 | −5.0 | −3.0 |
| S (wt %) | 4.31 | 4.27 | 1.11 | 1.82 | 3.07 |
| N (wppm) | 1940 | 2010 | 1390 | 1560 | 1750 |
| H (wt %) | 6.6 | 6.5 | 8.4 | 7.0 | 7.3 |
| MCR (wt %) | 11.5 | 14.6 | 4.7 | 13.4 | 12.5 |
| n-heptane insolubles (wt %) | 4.0 | 8.7 | 0.4 | 5.0 | 0.7 |
| GCD (ASTM D2887) (wt %) | | | | | |
| <316° C. | 2 | | 4 | | 3 |
| 316° C.-371° C. | 11 | | 13 | | 12 |
| 371° C.-427° C. | 43 | | 40 | | 36 |
| 427° C.-482° C. | 27 | | 26 | | 28 |
| 482° C.-538° C. | 7 | | 10 | | 10 |
| 538° C.-566° C. | 2 | | 2 | | 2 |
| 566° C.+ | 8 | | 5 | | 9 |

As shown in Table 1, typical catalytic slurry oils (or blends of such slurry oils) can represent a low value and/or challenged feed. The catalytic slurry oils have an API Gravity at 15° C. of less than 1.5, and often less than 0. The catalytic slurry oils can have sulfur contents of greater than 1.0 wt %, nitrogen contents of at least 1000 wppm, and hydrogen contents of less than 8.5 wt %, or less than 7.5 wt %, or less than 7.0 wt %. The catalytic slurry oils can also be relatively high in micro carbon residue (MCR), with values of at least 4.5 wt %, or at least 6.5 wt %, and in some cases greater than 10 wt %. The catalytic slurry oils can also contain a substantial n-heptane insolubles (asphaltene) content, for example at least 0.3 wt %, or at least 1.0 wt %, or at least 4.0 wt %. It is noted that the boiling range of the catalytic slurry oils has more in common with a vacuum gas oil than a vacuum resid, as less than 10 wt % of the catalytic slurry oils corresponds to 566° C.+ compounds, and less than 15 wt % corresponds to 538° C.+ compounds.

Table 2 provides characterization of deasphalted oils made from the catalytic slurry oils corresponding to CSO 2 and CSO 4. The deasphalted oils in Table 2 were formed by solvent deasphalting with n-pentane at a 6:1 (by volume) solvent to oil ratio. The deasphalting was performed at 600 psig (~4.1 MPag) within a top tower temperature window of 150° C. to 200° C. Under the deasphalting conditions, the yield of deasphalted oil was at least 90 wt %.

TABLE 2

Characterization of Deasphalted Oils derived from Catalytic Slurry Oils

| | DAO 2 | DAO 4 |
|---|---|---|
| API Gravity (15° C.) | −6.0 | −3.0 |
| S (wt %) | 4.31 | 1.81 |
| N (wppm) | 2060 | 1530 |
| H (wt %) | 6.8 | 7.3 |
| MCR (wt %) | 7.0 | 6.6 |
| n-heptane insolubles (wt %) | 0.04 | 0.2 |
| GCD (ASTM D2887) (wt %) | | |
| <316° C. | 2 | 6 |
| 316° C.-371° C. | 13 | 23 |
| 371° C.-427° C. | 48 | 40 |

TABLE 2-continued

| Characterization of Deasphalted Oils derived from Catalytic Slurry Oils | | |
|---|---|---|
| | DAO 2 | DAO 4 |
| 427° C.-482° C. | 25 | 19 |
| 482° C.-538° C. | 7 | 6 |
| 538° C.-566° C. | 1 | 1 |
| 566° C.+ | 4 | 5 |

As shown in Table 2, some of the properties of the deasphalted oil generated from catalytic slurry oil were similar to the original feed. For example, the API Gravity, sulfur, and nitrogen contents of DAO 2 and DAO 4 were similar to corresponding contents in CSO 2 and CSO 4, respectively. The boiling point profiles of DAO 2 and DAO 4 were also at least qualitatively similar to the boiling ranges for CSO 1 and CSO 3.

The most notable difference between DAO 2 and DAO 4 in Table 2 relative to CSO 2 and CSO 4 in Table 1 is in the n-heptane insolubles content. Both DAO 2 and DAO 4 had a n-heptane insoluble content of 0.2 wt % or less, while the corresponding catalytic slurry oils had n-heptane insoluble contents that were at least an order of magnitude higher.

Deasphalting also appeared to have a beneficial impact on the amount of micro carbon residue (MCR). In particular, it was unexpectedly discovered that performing deasphalting on a catalytic slurry oil feed can result in a net reduction in the amount of MCR, and therefore a net reduction in the amount of coke that is eventually formed from an initial feedstock. To further illustrate the benefit of performing deasphalting on a catalytic slurry oil feed, Table 3 provides additional characterization details for DAO 2 and DAO 4, along with characterization of the corresponding rock made when forming DAO 2 and DAO 4. Some characterization of two additional deasphalted oils (DAO 5 and DAO 6) and the corresponding rock fractions is also included in Table 3.

TABLE 3

| Micro Carbon Residue content in Catalytic Slurry Oil DAO and Rock | | | | | | | | |
|---|---|---|---|---|---|---|---|---|
| | | DAO Yield | Rock Composition (wt %) | | | DAO | Combined MCR of DAO + Rock | Feed |
| | S:O | (wt %) | C | H | MCR | MCR | (per 100 g feed) | MCR |
| CSO 2 | 6 | 93 | 90.1 | 5.2 | 64.8 | 7.0 | 11.46 | 14.6 |
| CSO 4 | 6 | 95 | 81.9 | 5.3 | 52.4 | 6.6 | 8.9 | 13.4 |
| CSO 5 | 4 | 92 | 91.5 | 5.2 | 64.3 | | | |
| CSO 6 | 3 | 86 | 92.1 | 5.3 | 60.1 | | | |

In Table 3, "S:O" refers to the solvent to oil ratio (by volume) used to form the deasphalted oil and rock fractions. The solvent was n-pentane. The next column provides the average yield of deasphalted oil under the deasphalting conditions (pressure of ~4.1 MPag, temperature 150° C.-200° C.). The next three columns provide characterization of the rock formed during deasphalting, including the MCR content. The final two columns provide the MCR content of the deasphalted oil and the MCR content of the catalytic slurry oil feed prior to deasphalting.

As shown in Table 3, deasphalting of CSO 2 and CSO 4 resulted in formation of deasphalted oils that had roughly half the MCR content of the feed. However, even though the corresponding rock fractions for DAO 2 and DAO 4 had MCR contents of greater than 50 wt %, due to the low yield of rock, the net amount of MCR content in the combined DAO and rock after deasphalting was reduced. For example, the initial MCR content of CSO 4 was roughly 13.4 wt %. DAO 2 had a MCR content of 6.6 wt %, while the corresponding rock fraction had a MCR content of roughly 65 wt %. Based on these values, for each 100 grams of initial feed corresponding to CSO 4, the combined amount of MCR in DAO 4 and the corresponding rock fraction was only about 9 grams, as opposed to the 13.4 grams that would be expected based on the MCR content of CSO 4. Similarly, for each 100 grams of CSO 2 that was deasphalted, the resulting deasphalted oil and rock had a combined MCR content of less than 12 grams, as opposed to the expected 14.6 grams. Thus, deasphalting led to a net reduction in MCR content in the deasphalting products of at least 10 wt % relative to the MCR content of the feed, or at least 15 wt %, or at least 20 wt %, such as up to 40 wt % or more of reduction in MCR content. This unexpected reduction in MCR content can facilitate reduced production of coke in the eventual products. Reducing coke production can allow for a corresponding increase in production of other beneficial products, such as fuel boiling range compounds.

Table 3 also provides the carbon and hydrogen contents of the rock fractions produced during deasphalting of the various catalytic slurry oil feeds. As shown in Table 3, all of the rock fractions had a hydrogen content of less than about 5.5 wt %. This is an unexpectedly low hydrogen content for a fraction generated from an initial feed in a liquid state.

Example 3—Hydroprocessing of a Blend of Catalytic Slurry Oils

The blend of catalytic slurry oils (CSO X) from Table 1 was used as a feedstock for a pilot scale processing plant. The blend of catalytic slurry oils had a density of 1.12 g/cm$^3$, a T10 distillation point of 354° C., a T50 of 427° C., and a T90 of 538° C. The blend contained roughly 12 wt % MCR, had a sulfur content of ~3 wt %, a nitrogen content of 2500 wppm, and a hydrogen content of ~7.4 wt %. A compositional analysis of the blend determined that the blend included 10 wt % saturates, 70 wt % aromatics with 4 or more rings, and 20 wt % aromatics with 1-3 rings.

The blend was used as a feedstock for hydroprocessing. The feedstock was exposed to a commercially available medium pore NiMo supported hydrotreating catalyst. The start of cycle conditions were a total pressure of ~2600 psig, ~0.25 LHSV, ~370° C., and ~10,000 SCF/B of hydrogen treat gas. The conditions resulted in total product with an organic sulfur content of about 125 wppm. The total product from hydroprocessing was analyzed. The total product at start of run included 3 wt % $H_2S$; 1 wt % of $C_{4-}$ (i.e., light ends); 5 wt % naphtha boiling range compounds; 47 wt % of 177° C.-371° C. (diesel boiling range) compounds, which had a sulfur content of less than 15 wppm; and 45 wt % of 371° C.+ compounds. The 371° C.+ compounds had a specific gravity of ~1.0 g/cm$^3$. The 371° C.+ fraction was suitable for use as a hydrocracker feed, a FCC feed, and/or sale as a fuel oil. The yield of 566° C.+ compounds was 2.5 wt %. Hydrogen consumption at the start of hydroprocessing was ~3400 SCF/B. The feed was processed in the pilot reactor for 300 days, with adjustments to the conditions to maintain the organic sulfur content in the total product at roughly 125 wppm. The end of cycle conditions were ~2600 psig, ~0.25 LHSV, ~410° C., and ~10,000 SCF/B of hydrogen treat gas. The total product at end of run included 3 wt % $H_2S$; 3 wt % of $C_{4-}$ (i.e., light ends); 8 wt % naphtha boiling range compounds; 45 wt % of 177° C.-371° C. (diesel boiling range) compounds, which had a sulfur content of less than 15 wppm; and 41 wt % of 371° C.+ compounds with a specific gravity of 1.0 g/cm$^3$. Hydrogen consumption at the end of hydroprocessing was ~3300 SCF/B. By the end of the run, greater than 90 wt % of the 566° C.+ compounds were being converted. There was no build up in pressure during the course of the run. This lack of pressure build up and the general stability of the run, particularly at the end of run conditions which included a temperature of 410° C., was surprising.

Figure 4:
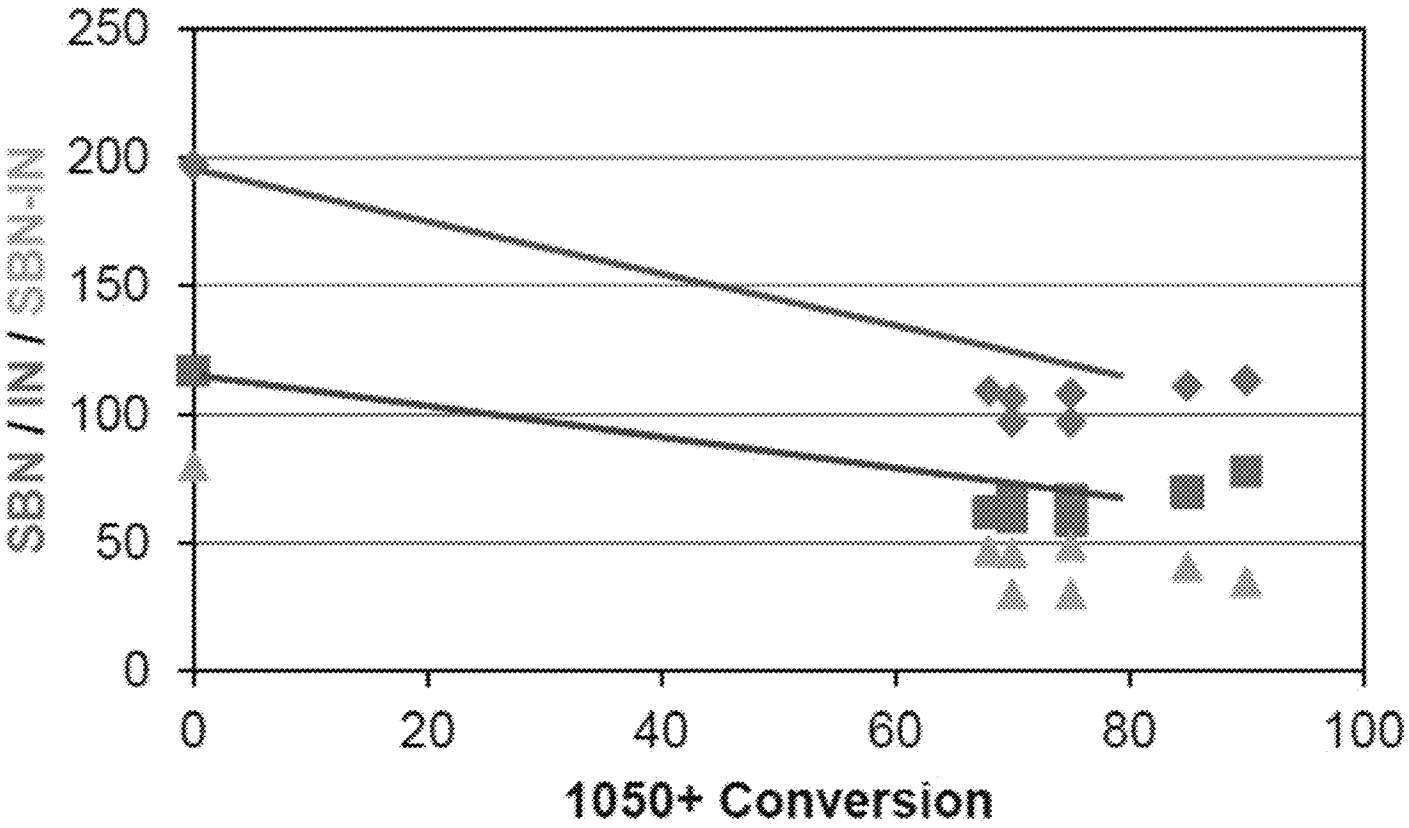
FIG. 4 shows results related to solubility number and insolubility number from hydrotreatment of a catalytic slurry oil.

Without being bound by any particular theory, it is believed that the surprising stability of the process is explained in part by the $S_{BN}$ and $I_N$ values of the hydrotreated effluent during the course of the processing run, and the corresponding difference between those values. FIG. 4 shows measured values for the $S_{BN}$ and $I_N$ of the liquid portion ($C_{5+}$) of the hydroprocessed effluent in relation to the amount of 566° C.+ conversion. The amount of 566° C.+ conversion roughly corresponds to the length of processing time, as the amount of conversion roughly correlates with the temperature increases required to maintain the organic sulfur content of the hydroprocessed effluent at the desired target level of ~125 wppm. As shown in FIG. 4, both the $S_{BN}$ and the $I_N$ of the hydroprocessed effluent decrease with increasing conversion, but the difference between $S_{BN}$ and $I_N$ in the hydroprocessed effluent remains relatively constant at roughly 40 to 50. This unexpectedly large difference in $S_{BN}$ and $I_N$ even at 90+ wt % conversion relative to 566° C. indicates that the hydroprocessed effluent should have a low tendency to cause coke formation in the reactor and/or otherwise deposit solids that can cause plugging.

Example 4—Hydroprocessing of Combined Catalytic Slurry Oil and Coker Bottoms A reactor and catalyst similar to those used in Example 3 was used to process a combined feed that contained about 80 wt % of the catalytic slurry oil blend from Example 3 (CSO X) and about 20 wt % of coker bottoms. The coker bottoms had a density of 0.99 g/cm$^3$, a T10 distillation point of 337° C., a T50 of 462° C., and a T90 of 553° C. The coker bottoms contained roughly 6.4 wt % MCR, had a sulfur content of ~3.7 wt %, a nitrogen content of ~5500 wppm, and a hydrogen content of ~10 wt %. A compositional analysis of the blend determined that the blend included 20 wt % saturates, 38 wt % aromatics with 4 or more rings (also including polars and sulfides), and 42 wt % aromatics with 1-3 rings.

The reactor and catalyst similar to those used in Example 3 were initially used to process the CSO X feed from Example 3 for about 100 days at 2400 psig, 0.25 hr$^{-1}$ LHSV, ~10,000 SCF/B of $H_2$ treat gas, and a temperature of 340° C.-380° C. The feed was then switched to the blend containing 80 wt % CSO X and 20 wt % of the coker bottoms for 14 days. The feed corresponding to the blend of CSO X and coker bottoms had a $S_{BN}$ of 190 and an $I_N$ of 110. No observable pressure build up was observed during processing of the combined feed. After 3 days of processing, the effluent was sampled and characterized. The total product from the hydrotreatment had an organic sulfur content of 210 wppm and a density of 0.97 g/cm$^3$. The composition of the total product included 3 wt % $H_2S$; 1.5 wt % of $C_{4-}$ (i.e., light ends); 3 wt % naphtha boiling range compounds; 43.5 wt % of 177° C.-371° C. (diesel boiling range) compounds, which had a sulfur content of less than 15 wppm; and 50 wt % of 371° C.+ compounds with a specific gravity of 1.0 g/cm$^3$. It is noted that a similar total product composition was observed after hydroprocessing CSO X with a 200 wppm organic sulfur content target after about 170 days of processing, although the total product had a density of 0.98 g/cm$^3$ instead of 0.97 g/cm$^3$.

Example 5—Hydroprocessing of Deasphalted Oil Based on Catalytic Slurry Oil, Coker Bottoms, and Vacuum Resid A blended feedstock was formed that included 50 wt % of CSO X (described in Example 3), 25 wt % of the coker bottoms described in Example 4, and 25 wt % of a vacuum resid. The blended feedstock was exposed to pentane deasphalting conditions to produce 89 wt % deasphalted oil and 11 wt % rock. The deasphalted oil contained <10 wppm metals, <0.1 wt % n-heptane insolubles, and <25 wppm solids. The deasphalted oil included 16 wt % of 566° C.+ content. The blended feedstock corresponding to a blend of CSO X, coker bottoms, and vacuum resid, prior to deasphalting, had a $S_{BN}$ of 160 and an $I_N$ of 110.

The deasphalted oil was hydrotreated using a system and catalyst similar to that described in Example 3. The deasphalted oil was hydrotreated at 2400 psig, 0.25 hr$^{-1}$ LHSV, 10,000 SCF/B of $H_2$ treat gas, and a temperature of 385° C. The total product from hydrotreatment of the deasphalted oil had an organic sulfur content of ~125 wppm and a density of 0.96 g/cm$^3$. The composition of the total product included 3 wt % $H_2S$; 1.5 wt % of $C_{4-}$ (i.e., light ends); 3 wt % naphtha boiling range compounds; 52 wt % of 177° C.-371° C. (diesel boiling range) compounds, which had a sulfur content of less than 15 wppm; and 40 wt % of 371° C.+ compounds with a specific gravity of 0.99 g/cm$^3$. No pressure build up was observed during the course of processing the deasphalted oil.

ADDITIONAL EMBODIMENTS

Embodiment 1

A method for processing product fractions from a fluid catalytic cracking process and a coking process, comprising: exposing a feed comprising at least 10 wt % (or at least 40 wt %) catalytic slurry oil and 10-50 wt % coker bottoms to a hydroprocessing catalyst under effective fixed bed hydroprocessing conditions to form a hydroprocessed effluent, the coker bottoms having an aromatic carbon content of 20 wt % to 50 wt % relative to a weight of the coker bottoms.

Embodiment 2

The method of Embodiment 1, further comprising settling at least one of the catalytic slurry oil and the feed prior to exposing the feed to the hydroprocessing catalyst, the at least one of the catalytic slurry oil and the feed having a catalyst fines content of 1 wppm or less after settling.

Embodiment 3

The method of any of the above embodiments, wherein the effective hydroprocessing conditions are effective for 55 wt % or more conversion of the feed relative to 566° C. (or 65 wt % or more, or 75 wt % or more).

Embodiment 4

A method for processing a product fraction from a fluid catalytic cracking (FCC) process and a coking process, comprising: performing solvent deasphalting on a feed comprising at least 10 wt % of a catalytic slurry oil (or at least 30 wt %) and at least 10 wt % of a coker bottoms to form a deasphalted oil and a deasphalter residue, a yield of the deasphalted oil being about 50 wt % or more (or about 70 wt % or more, or about 80 wt % or more) relative to a weight of the feed; and exposing at least a portion of the deasphalted oil to a hydroprocessing catalyst under effective hydroprocessing conditions to form a hydroprocessed effluent.

Embodiment 5

The method of Embodiment 4, wherein the feed further comprises about 10 wt % to about 60 wt % of a vacuum resid fraction having a T10 distillation point of at least 510° C. (or at least 538° C., or at least 566° C.); or wherein the feed comprises at least 25 wppm of particles, the deasphalter residue comprises at least 100 wppm of particles, and the at least a portion of the deasphalted oil comprises 1 wppm or less of particles; or a combination thereof.

Embodiment 6

The method of any of the above embodiments, wherein a weight of catalytic slurry oil in the feed is equal to or greater than a weight of coker bottoms in the feed.

Embodiment 7

The method of any of the above embodiments, further comprising coking a first feedstock comprising a 566° C.+ portion in a coker to form at least a coker naphtha fraction, a coker gas oil fraction, and at least a portion of the coker bottoms; or further comprising exposing a second feedstock having a T90 distillation point of 566° C. or less to a catalyst under fluid catalytic cracking conditions to form at least an FCC naphtha fraction, a cycle oil, and at least a portion of the catalytic slurry oil; or a combination thereof.

Embodiment 8

The method of any of the above embodiments, wherein the coker bottoms comprises 4.0 wt % or more of micro carbon residue (or 6.0 wt % or more); or wherein the hydroprocessed effluent comprises 4.0 wt % or less of micro carbon residue (or 3.0 wt % or less, or 2.0 wt % or less); or wherein the catalytic slurry oil comprises 5.0 wt % or more of micro carbon residue (or 7.0 wt % or more, or 10 wt % or more); or a combination thereof.

Embodiment 9

The method of any of the above embodiments, wherein the feed and/or the at least a portion of the deasphalted oil comprises at least 1.0 wt % of organic sulfur, the hydroprocessed effluent comprising about 0.5 wt % or less of organic sulfur, or about 1000 wppm or less, or about 500 wppm or less, or about 200 wppm or less.

Embodiment 10

The method of any of the above embodiments, wherein the catalytic slurry oil comprises a 343° C.+ bottoms fraction from a fluid catalytic cracking process; or wherein the feed comprises about 50 wt % or more of the catalytic slurry oil, or about 70 wt % or more; or a combination thereof.

Embodiment 11

The method of any of the above embodiments, wherein the effective hydroprocessing conditions comprise effective hydrotreating conditions, effective hydrocracking conditions, demetallization conditions, or a combination thereof.

Embodiment 12

The method of any of the above embodiments, wherein a difference between $S_{BN}$ and $I_N$ for the feed is about 60 or less, or 50 or less, or 40 or less, and a difference between $S_{BN}$ and $I_N$ for the deasphalted oil is 60 or more, or 70 or more, or 80 or more; or a difference between $S_{BN}$ and $I_N$ for the deasphalted oil is at least 10 greater, or at least 20 greater, or at least 30 greater than a difference between $S_{BN}$ and $I_N$ for the feed; or a combination thereof.

Embodiment 13

A hydroprocessed effluent made according to the method of any of the above embodiments, the hdyroprocessed effluent optionally comprising a difference between $S_{BN}$ and $I_N$ of about 40 or more.

Embodiment 14

A system for processing a feedstock, comprising: a fluid catalytic cracker comprising a fluid catalytic cracking (FCC) inlet and an FCC outlet; a coker comprising a coker inlet and a coker outlet; and a hydroprocessing stage comprising a hydroprocessing inlet and a hydroprocessing outlet, the hydroprocessing inlet being in fluid communication with the coker outlet for receiving a coker bottoms fraction and in fluid communication with the FCC outlet for receiving a FCC bottoms fraction, the hydroprocessing stage optionally comprising a hydrotreating stage, the FCC inlet optionally being in fluid communication with the hydroprocessing outlet for receiving a hydroprocessed gas oil boiling range fraction.

Embodiment 15

The system of Embodiment 14, further comprising a solvent deasphalting unit comprising a deasphalter inlet and a deasphalter outlet, the deasphalter inlet being in fluid communication with the coker outlet and the FCC outlet, the hydroprocessing inlet being in indirect fluid communication with the coker outlet and the FCC outlet via the deasphalter outlet.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

The invention claimed is:

1. A method for processing product fractions from a fluid catalytic cracking process and a coking process, comprising:

performing solvent deasphalting on a feed comprising at least 10 wt % of a catalytic slurry oil and at least 10-50 wt % of a coker bottoms, the coker bottoms having an aromatic carbon content of 20 wt % to 50 wt % relative to a weight of the coker bottoms, to form a deasphalted oil and a deasphalter residue, a yield of the deasphalted oil being about 50 wt % or more relative to a weight of the feed having less than about 10 wppm of catalyst fines, and the deasphalter residue containing more than 100 wppm of catalyst fines; and exposing the deasphalted oil to a hydroprocessing catalyst under effective fixed bed hydroprocessing conditions to form a hydroprocessed effluent, wherein the hydroprocessed effluent comprises about 0.1 wt % or less of sulfur.

2. The method of claim 1, wherein a weight of catalytic slurry oil in the feed is equal to or greater than a weight of coker bottoms in the feed; or wherein the feed comprises 40 wt % or more of the catalytic slurry oil; or a combination thereof.

3. The method of claim 1, further comprising settling at least one of the catalytic slurry oil and the feed prior to exposing the deasphalted oil to the hydroprocessing catalyst, the at least one of the catalytic slurry oil and the deasphalted oil having a catalyst fines content of 1 wppm or less after settling.

4. The method of claim 1, wherein the effective hydroprocessing conditions are effective for 55 wt % or more conversion of the deasphalted oil relative to 566° C.

5. The method of claim 1, further comprising coking a first feedstock comprising a 566° C.+ portion in a coker to form at least a coker naphtha fraction, a coker gas oil fraction, and at least a portion of the coker bottoms.

6. The method of claim 1, further comprising exposing a second feedstock having a T90 distillation point of 566° C. or less to a catalyst under fluid catalytic cracking conditions to form at least an FCC naphtha fraction, a cycle oil, and at least a portion of the catalytic slurry oil.

7. The method of claim 1, wherein the coker bottoms has a T10 distillation point of at least 300° C.; or wherein the coker bottoms has a T90 distillation point of 566° C. or less; or a combination thereof.

8. The method of claim 1, wherein the coker bottoms comprises 4.0 wt % or more of micro carbon residue; or wherein the hydroprocessed effluent comprises 4.0 wt % or less of micro carbon residue; or wherein the catalytic slurry oil comprises 5.0 wt % or more of micro carbon residue; or a combination thereof.

9. The method of claim 1, wherein the feed comprises at least 1.0 wt % of organic sulfur, the hydroprocessed effluent comprising about 0.5 wt % or less of organic sulfur.

10. The method of claim 1, wherein the catalytic slurry oil comprises a 343° C.+ bottoms fraction from a fluid catalytic cracking process.

* * * * *